US011807489B2

(12) United States Patent
Sakai

(10) Patent No.: US 11,807,489 B2
(45) Date of Patent: Nov. 7, 2023

(54) MEDIUM CONVEYING APPARATUS TO CHANGE DETERMINATION THRESHOLD FOR MULTI-FEED OF MEDIUM ACCORDING TO SIZE OF OVERLAP AREA IN MEDIUM

(71) Applicant: PFU LIMITED, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 39 days.

(21) Appl. No.: 17/578,101

(22) Filed: Jan. 18, 2022

(65) Prior Publication Data

US 2022/0258996 A1 Aug. 18, 2022

(30) Foreign Application Priority Data

Feb. 18, 2021 (JP) ..... 2021-024578

(51) Int. Cl.
*B65H 7/12* (2006.01)
*B65H 7/18* (2006.01)

(52) U.S. Cl.
CPC ..... *B65H 7/125* (2013.01); *B65H 7/18* (2013.01); *B65H 2511/416* (2013.01); *B65H 2511/524* (2013.01); *B65H 2553/30* (2013.01); *B65H 2557/63* (2013.01)

(58) Field of Classification Search
CPC . B65H 7/00; B65H 7/12; B65H 7/125; B65H 7/18; B65H 2511/10; B65H 2511/13; B65H 2511/524; B65H 2553/30; B65H 2557/63
See application file for complete search history.

(56) References Cited

U.S. PATENT DOCUMENTS

2005/0228535 A1* 10/2005 Simonis ..... B65H 7/20 700/228
2011/0278786 A1* 11/2011 Yamagishi ..... B65H 7/125 271/265.04
2011/0278791 A1* 11/2011 Fujii ..... B65H 7/125 271/265.04
2011/0282487 A1* 11/2011 Niwano ..... B65H 7/125 700/228

(Continued)

FOREIGN PATENT DOCUMENTS

JP 7-291485 A 11/1995
JP 2009-286581 A 12/2009

*Primary Examiner* — Prasad V Gokhale
(74) *Attorney, Agent, or Firm* — LEWIS ROCA ROTHGERBER CHRISTIE LLP

(57) ABSTRACT

A medium conveying apparatus includes a conveying roller to convey a medium, and a processor to detect transmission information of an ultrasonic wave transmitted through the medium or thickness information of the medium at a plurality of positions in the conveyed medium, calculate a size of an area in which the transmission information or the thickness information is within a predetermined range in the conveyed medium, determine whether a multi-feed of the medium has occurred, by comparing a value based on the transmission information or the thickness information with a threshold, and execute an abnormality processing when it is determined that the multi-feed of the medium has occurred. The processor changes the threshold according to the size.

18 Claims, 11 Drawing Sheets

(56) References Cited

U.S. PATENT DOCUMENTS

| | | | | |
|---|---|---|---|---|
| 2012/0025458 | A1* | 2/2012 | Simonis | B65H 7/125<br>271/262 |
| 2014/0103599 | A1* | 4/2014 | Tojo | B65H 9/006<br>271/3.19 |

* cited by examiner

MEDIUM CONVEYING APPARATUS TO CHANGE DETERMINATION THRESHOLD FOR MULTI-FEED OF MEDIUM ACCORDING TO SIZE OF OVERLAP AREA IN MEDIUM

CROSS-REFERENCE TO RELATED APPLICATIONS

This application is based upon and claims the benefit of priority of prior Japanese Patent Application No. 2021-024578, filed on Feb. 18, 2021, the entire contents of which are incorporated herein by reference.

TECHNICAL FIELD

Embodiments discussed in the present specification relate to medium conveyance.

BACKGROUND

In general, a medium conveying apparatus such as a scanner has a function of detecting whether or not a multi-feed, that is, a plurality of media being conveyed in an overlapping manner has occurred, and automatically stopping the conveyance of the medium when the multi-feed has occurred. However, even when a medium to which a photograph is adhered, such as a resume, is transported, the medium conveying apparatus may determine that the multi-feed has occurred, and stop the conveyance. Therefore, when a user uses the medium conveying apparatus to scan the medium to which the photograph is adhered, the user needs to set the detection function of the multi-feed to OFF before the conveyance of the medium, thereby the convenience of the user is impaired.

A multi-feed detecting apparatus including a conveying roller to convey a document and a driven roller pressed against the conveying roller with a predetermined pressing force and displaced according to a thickness of the document is disclosed (Japanese Unexamined Patent Publication (Kokai) No. H7-291485). The multi-feed detecting apparatus controls to prohibit the multi-feed determination when a displacement amount of the driven roller, detected while the document passes between the two rollers, is increased for a time shorter than a predetermined time.

A method of receiving a processed object and detecting a multi-feed of the object is disclosed (U.S. Patent Application Publication No. 2005/0228535). In this method, it is determined whether or not an overlap position of the multi-feed of the object is within an allowable range, and the processing of the object is continued when the position is within a predetermined overlap criterion, and the processing of the object is aborted when the position is not within the predetermined overlap criterion.

SUMMARY

According to some embodiments, a medium conveying apparatus includes a conveying roller to convey a medium, and a processor to detect transmission information of an ultrasonic wave transmitted through the medium or thickness information of the medium at a plurality of positions in the conveyed medium, calculate a size of an area in which the transmission information or the thickness information is within a predetermined range in the conveyed medium, determine whether a multi-feed of the medium has occurred, by comparing a value based on the transmission information or the thickness information with a threshold, and execute an abnormality processing when it is determined that the multi-feed of the medium has occurred. The processor changes the threshold according to the size.

According to some embodiments, a method for determining a multi-feed of a medium, includes, conveying the medium, by a conveying roller, detecting transmission information of an ultrasonic wave transmitted through the medium or thickness information of the medium at a plurality of positions in the conveyed medium, calculating a size of an area in which the transmission information or the thickness information is within a predetermined range in the conveyed medium, determining whether a multi-feed of the medium has occurred, by comparing a value based on the transmission information or the thickness information with a threshold, and executing an abnormality processing when it is determined that the multi-feed of the medium has occurred. The threshold is changed according to the size.

According to some embodiments, a computer-readable, non-transitory medium stores a computer program. The computer program causes a medium conveying apparatus including a conveying roller to convey a medium, to execute a process including detecting transmission information of an ultrasonic wave transmitted through the medium or thickness information of the medium at a plurality of positions in the conveyed medium, calculating a size of an area in which the transmission information or the thickness information is within a predetermined range in the conveyed medium, determining whether a multi-feed of the medium has occurred, by comparing a value based on the transmission information or the thickness information with a threshold, and executing an abnormality processing when it is determined that the multi-feed of the medium has occurred. The threshold is changed according to the size.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for determining a multi-feed of a medium, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
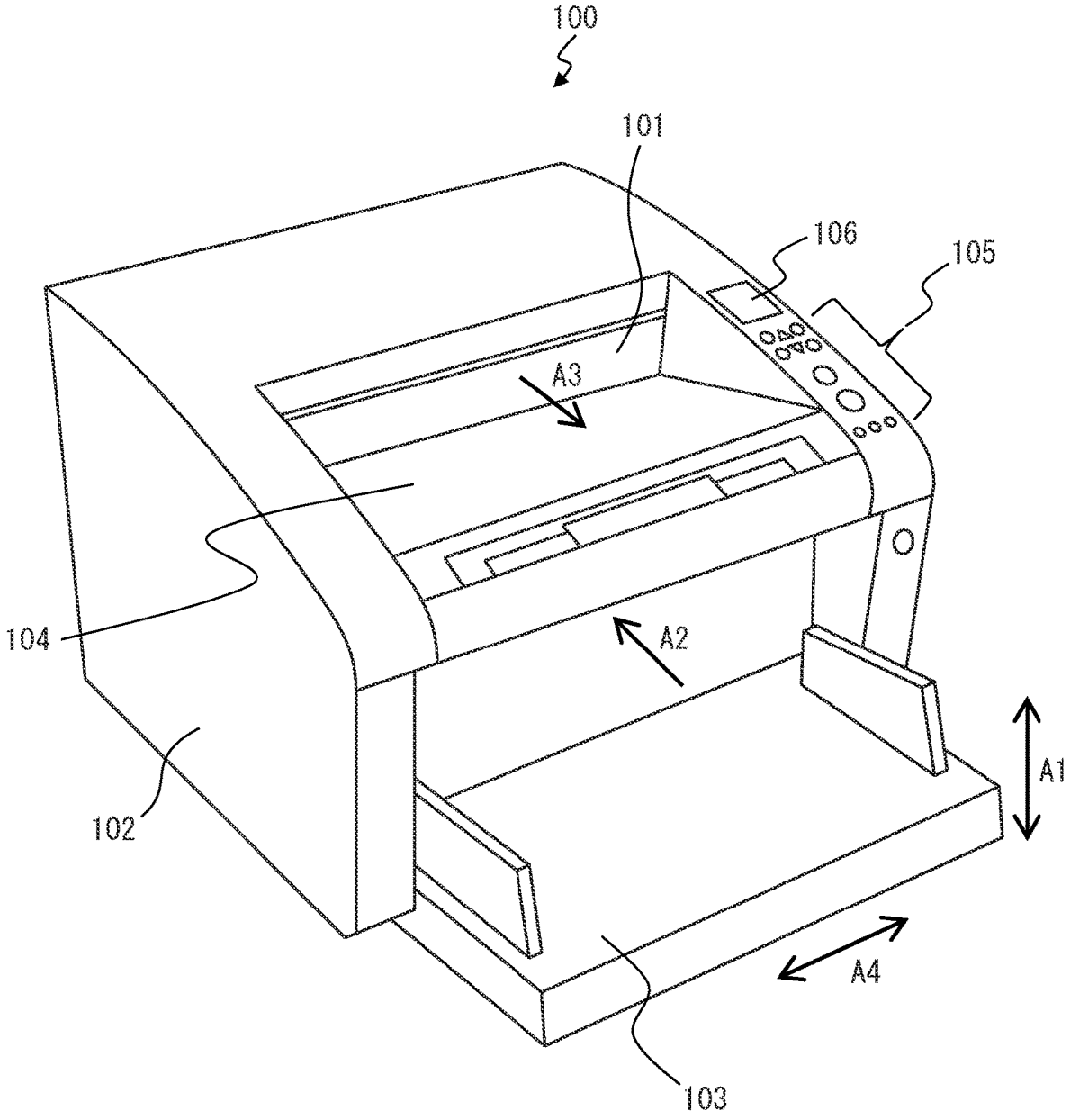
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper, a thick paper, a card, etc. The medium also includes a medium on which adhered object, such as a label (a seal) or a small size paper piece (a photograph, a cutout, a postage stamp, a revenue stamp, etc.), is adhered. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a first housing 101, a second housing 102, a medium tray 103, an ejection tray 104, an operation device 105 and a display device 106, etc.

The first housing 101 is located on an upper side of the medium conveying apparatus 100 and is engaged with the second housing 102 by hinges so as to be opened and closed at a time of medium jam, during cleaning the inside of the medium conveying apparatus 100, etc.

The medium tray 103 is engaged with the second housing 102 in such a way as to be able to place a medium to be conveyed. The medium tray 103 is provided on a side surface of the second housing 102 on a medium supply side to be movable in a substantially vertical direction (height direction) A1 by a motor (not shown). The medium tray 103 is located at a position of a lower end to easily place a medium on the medium tray 103 when the medium is not conveyed, and lifts to a position at which the medium placed on the uppermost side is in contact with a pick roller to be described later when the medium is conveyed. The ejection tray 104 is formed on the first housing 101 capable of holding the ejected medium, to load the ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

In FIG. 1, an arrow A2 indicates a medium conveying direction, an arrow A3 indicates a medium ejecting direction, and an arrow A4 indicates a width direction perpendicular to the medium conveying direction. Hereinafter, upstream refers to upstream of the medium conveying direction A2 or the medium ejecting direction A3, downstream refers to downstream of the medium conveying direction A2 or the medium ejecting direction A3.

Figure 2:
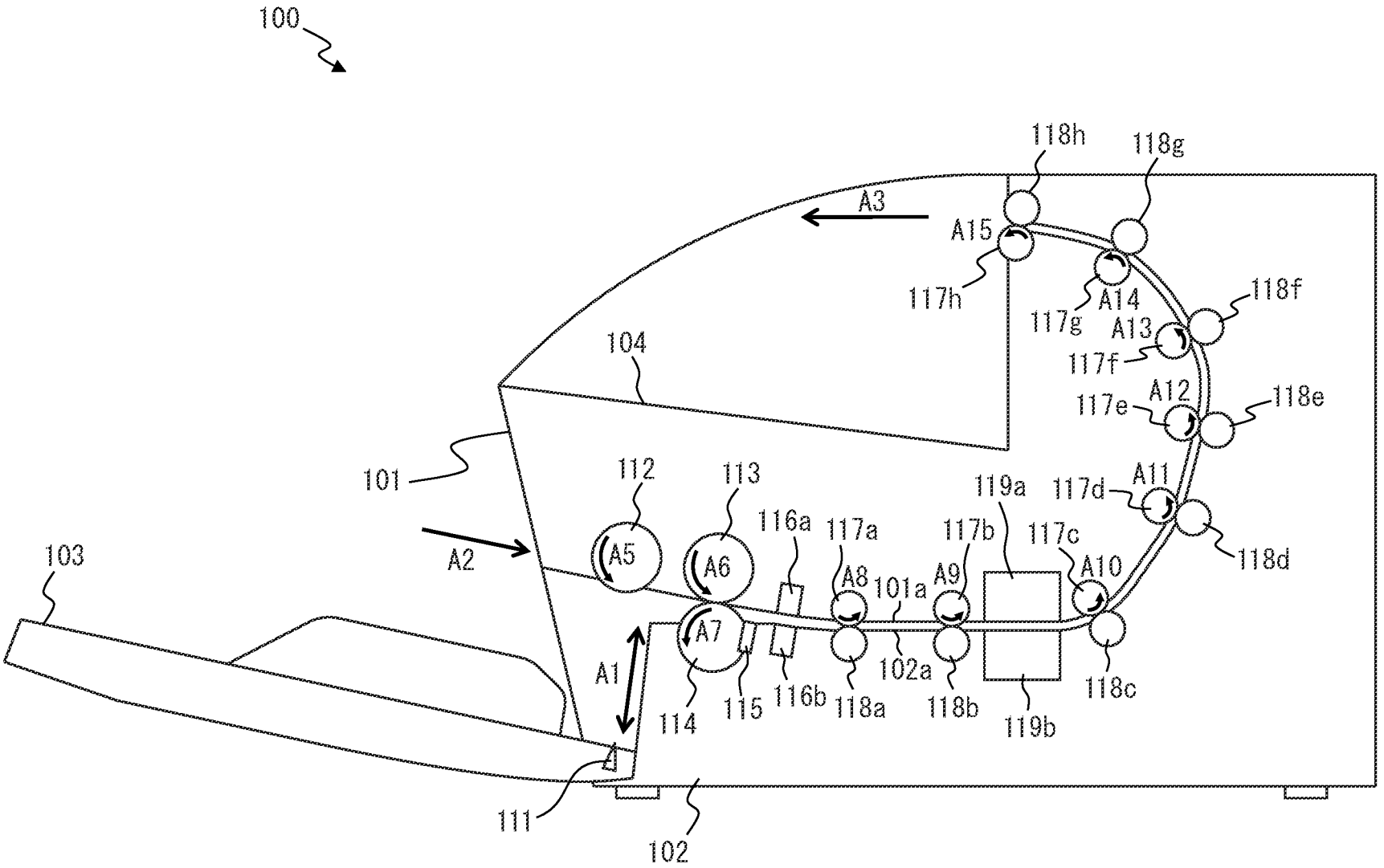
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a first medium sensor 111, a pick roller 112, a feed roller 113, a brake roller 114, a second medium sensor 115, an ultrasonic transmitter 116*a*, an ultrasonic receiver 116*b*, first to eighth conveyance rollers 117*a* to 117*h*, first to eighth driven rollers 118*a* to 118*h*, a first imaging device 119*a* and a second imaging device 119*b*, etc.

The pick roller 112, the feed roller 113, the brake roller 114, the first to eighth conveyance rollers 117*a* to 117*h*, and the first to eighth driven rollers 118*a* to 118*h* are examples of a conveying roller to convey the medium. The number of each of the pick roller 112, the feed roller 113, the brake roller 114, the first to eighth conveyance rollers 117*a* to 117*h*, and/or the first to eighth driven rollers 118*a* to 118*h* is not limited to one, and may be plural. In that case, the plurality of pick rollers 112, the feed rollers 113, the brake rollers 114, the first to eighth conveyance rollers 117*a* to 117*h* and/or the first to eighth driven rollers 118*a* to 118*h* are spaced and located along in the width direction A4, respectively. Hereinafter, the first imaging device 119*a* and the second imaging device 119*b* may be collectively referred to as imaging devices 119.

The surface of the first housing 101 facing the second housing 102 forms a first guide 101*a* of the medium conveyance path, and the surface of the second housing 102 facing the first housing 101 forms a second guide 102*a* of the medium conveyance path.

The first medium sensor 111 is located on the medium tray 103, i.e., on the upstream side of the feed roller 113 and the brake roller 114, to detect a placing state of the medium in the medium tray 103. The first medium sensor 111 determines whether or not the medium is placed on the medium tray 103, by a contact detection sensor to pass a predetermined current when a medium is in contact or a medium is not in contact. The first medium sensor 111 generates and outputs a first medium detection signal changing the signal value between a state in which a medium is placed on the medium tray 103 and a state in which a medium is not placed. The first medium sensor 111 is not limited to the contact detection sensor, and any other sensor, such as a light detection sensor, capable of detecting the presence or absence of the medium may be used as the first sensor 111.

The pick roller 112 is provided in the first housing 101, and comes into contact with the medium placed on the medium tray 103 lifted to a height substantially equal to that of the medium conveyance path to feed the medium to the downstream side.

The feed roller 113 is located in the first housing 101, and on the downstream side of the pick roller 112, to feed the medium placed on the medium tray 103 and fed by the pick roller 112 toward the further downstream side. The brake roller 114 is located in the second housing 102, to face the feed roller 113. The feed roller 113 and the brake roller 114 perform a medium separation operation to separate the media and feed them one by one. The feed roller 113 is located on the upper side with respect to the brake roller 114, the medium conveying apparatus 100 feeds the medium by a so-called top-first type.

The second medium sensor 115 is located on the downstream side of the feed roller 113 and the brake roller 114 and on the upstream side of the ultrasonic transmitter 116*a* and the ultrasonic receiver 116*b*. The second medium sensor 115 detects whether or not the medium exists at the second medium sensor 115. The second medium sensor 115 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light emitted by the light emitter and reflected by the reflection member, and generates and outputs a second medium signal being an electric signal corresponding to the intensity of the received light. Since the light emitted by the light emitter is shielded by the medium when the medium exists at the position of the second medium sensor 115, a signal value of the second medium signal is changed in a state in which the medium exists at the position of the second medium sensor 115 and a state in which a medium does not exist at the position. The light emitter and the light receiver may be provided at positions facing one another with the conveyance path in between, and the reflection member may be omitted.

The ultrasonic transmitter 116*a* and the ultrasonic receiver 116*b* are located on the downstream side of the feed roller 113 and the brake roller 114 and on the upstream side of the first to eighth conveyance rollers 117*a* to 117*h* and the first to eighth driven rollers 118*a* to 118*h*. The ultrasonic transmitter 116*a* and the ultrasonic receiver 116*b* are located close to the conveyance path of the medium in such a way as to face one another with the conveyance path in between. The ultrasonic transmitter 116*a* outputs an ultrasonic wave. On the other hand, the ultrasonic receiver 116*b* receives the ultrasonic wave transmitted by the ultrasonic transmitter 116*a* and passing through the medium, and generates and outputs an ultrasonic signal being an electric signal corresponding to the received ultrasonic wave. The ultrasonic signal indicates a transmission information of the ultrasonic wave transmitted through the medium at a plurality of positions in the medium conveyed by the conveying roller. The transmission information indicates the magnitude of the ultrasonic wave received by the ultrasonic receiver 116*b*. Hereinafter, the ultrasonic transmitter 116*a* and the ultrasonic receiver 116*b* may be collectively referred to as an ultrasonic sensor 116. The number of ultrasonic sensors 116 is not limited to one, and may be plural. In that case, a plurality of ultrasonic sensors 116 are spaced and located along in the width direction A4.

The first to eighth conveying rollers 117*a* to 117*h* and the first to eighth driven rollers 118*a* to 118*h* are provided on the downstream side of the feed roller 113 and the brake roller 114, to convey the medium fed by the feed roller 113 and the brake roller 114 toward the downstream side. The first to eighth conveying rollers 117*a* to 117*h* and the first to eighth driven rollers 118*a* to 118*h* are located to face each other with the medium conveyance path in between.

The first imaging device 119*a* is an example of an imaging device, and is provided on the downstream side of the first conveying roller 117*a* and the first driven roller 118*a* in the medium conveying direction A2, i.e., on the downstream side of the ultrasonic sensor 116. The first imaging device 119*a* includes a line sensor based on a unity-magnification optical system type contact image sensor (CIS) including an imaging element based on a complementary metal oxide semiconductor (CMOS) linearly located in a main scanning direction. Further, the first imaging device 119*a* includes a lens for forming an image on the imaging element, and an A/D converter for amplifying and analog-digital (A/D) converting an electric signal output from the imaging element. The first imaging device 119*a* generates and outputs an input image by imaging a front side of the conveyed medium.

Similarly, the second imaging device 119*b* is an example of an imaging device, and is provided on the downstream side of the first conveying roller 117*a* and the first driven roller 118*a* in the medium conveying direction A2. The second imaging device 119*b* includes a line sensor based on a unity-magnification optical system type CIS including an imaging element based on a CMOS linearly located in a main scanning direction. Further, the second imaging device 119*b* includes a lens for forming an image on the image element, and an A/D converter for amplifying and analog-digital (A/D) converting an electric signal output from the imaging element. The second imaging device 119*b* generates and outputs an input image by imaging a back side of the conveyed medium.

Only either of the first imaging device 119*a* and the second imaging device 119*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs may be used.

A medium placed on the medium tray 103 is conveyed in the medium conveying direction A2 between the first guide 101*a* and the second guide 102*a* by the pick roller 112 rotating in a medium feeding direction A5 and the feed roller 113 rotating in a medium feeding direction A6. On the other hand, when a plurality of media are placed on the medium tray 103, only a medium in contact with the feed roller 113, out of the media placed on the medium tray 103 is separated, by the brake roller 114 rotating in a direction A7 opposite to the medium feeding direction.

While being guided by the first guide 101*a* and the second guide 102*a*, the medium is fed to the imaging position of the imaging device 119 by the first to second conveyance rollers 117*a* to 117*b* rotating in directions of arrows A8 to A9, and is imaged by the imaging device 119. The medium is ejected on the ejection tray 104 by the third to eighth conveyance rollers 117*c* to 117*h* rotating in directions of arrows A10 to A15, respectively. The ejection tray 104 loads the medium ejected by the eighth conveyance roller 117*h*.

Figure 3:
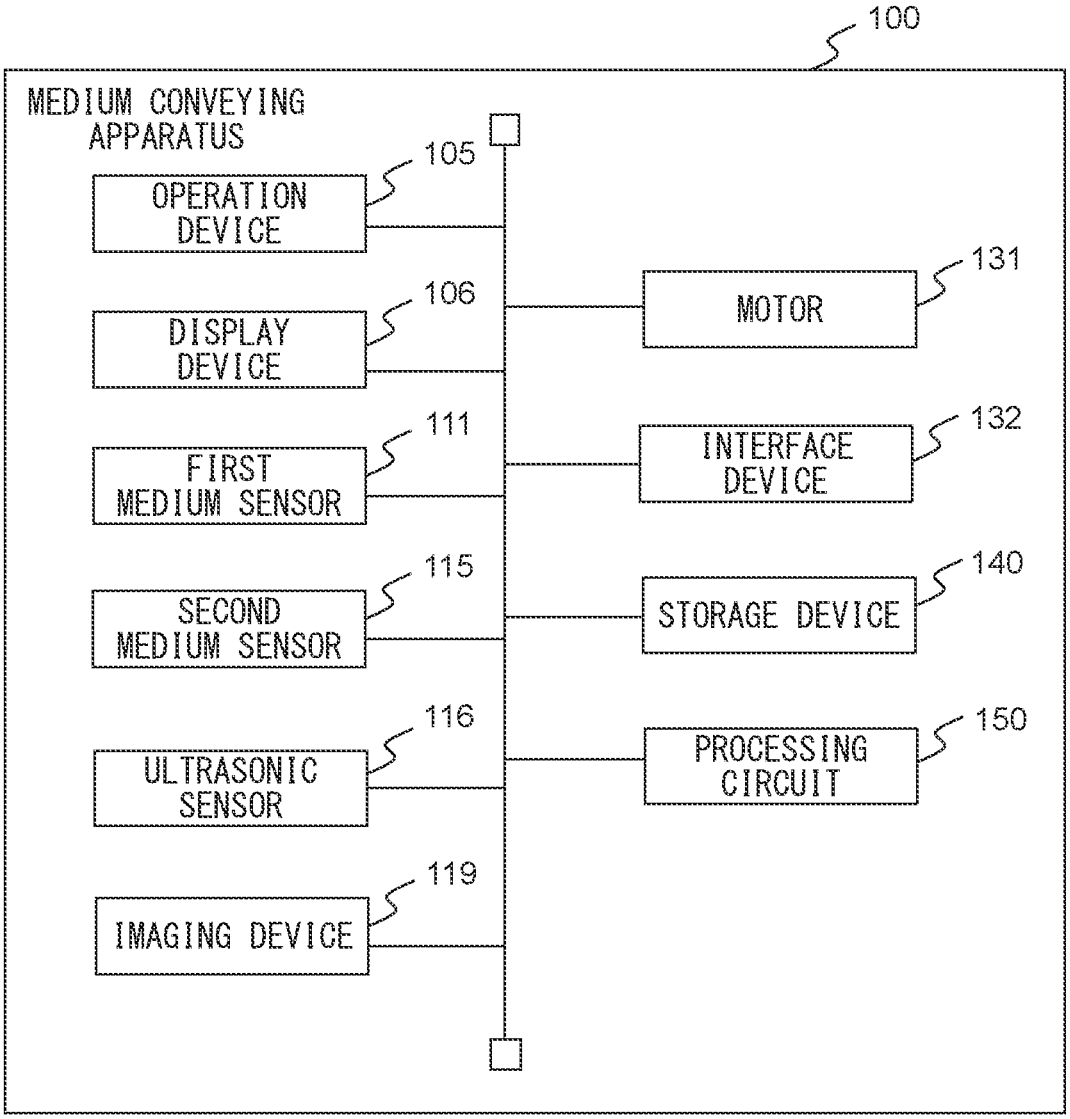
FIG. 3 is a block diagram illustrating a schematic configuration of the medium conveying apparatus 100.

FIG. 3 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors and rotates the pick roller 112, the feed roller 113, the brake roller 114, and the first to eighth conveyance rollers 117*a* to 117*h* by a control signal from the processing circuit 150 to feed and convey the medium. The first to eighth driven rollers 118*a* to 118*h* may be provided to rotate by the driving force from the motor rather than to be driven to rotate according to the rotation of each conveyance roller.

The interface device 132 includes, for example, an interface circuit conforming to a serial bus such as universal serial bus (USB), is electrically connected to an unillustrated information processing apparatus (for example, a personal computer or a mobile information terminal), and transmits and receives an input image and various types of information. Further, a communication device including an antenna transmitting and receiving wireless signals, and a wireless communication interface circuit for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the first medium sensor 111, the second medium sensor 115, the ultrasonic sensor 116, the imaging device 119, the motor 131, the interface device 132 and the storage device 140, etc., and controls each of these units. The processing circuit 150 controls the motor 131 to convey the medium, controls the imaging device 119 to acquire an input image, and transmits the acquired input image to the information processing apparatus via the interface device 132. Further, the processing circuit 150 determines whether or not the multi-feed of the medium has occurred based on the ultrasonic signal received from the ultrasonic sensor 116. In particular, the processing circuit 150 changes the multi-feed threshold for comparison with the magnitude of the ultrasonic wave, according to the size of an area in which the magnitude of the ultrasonic wave is within a predetermined range. The multi-feed threshold is an example of a threshold.

Figure 4:
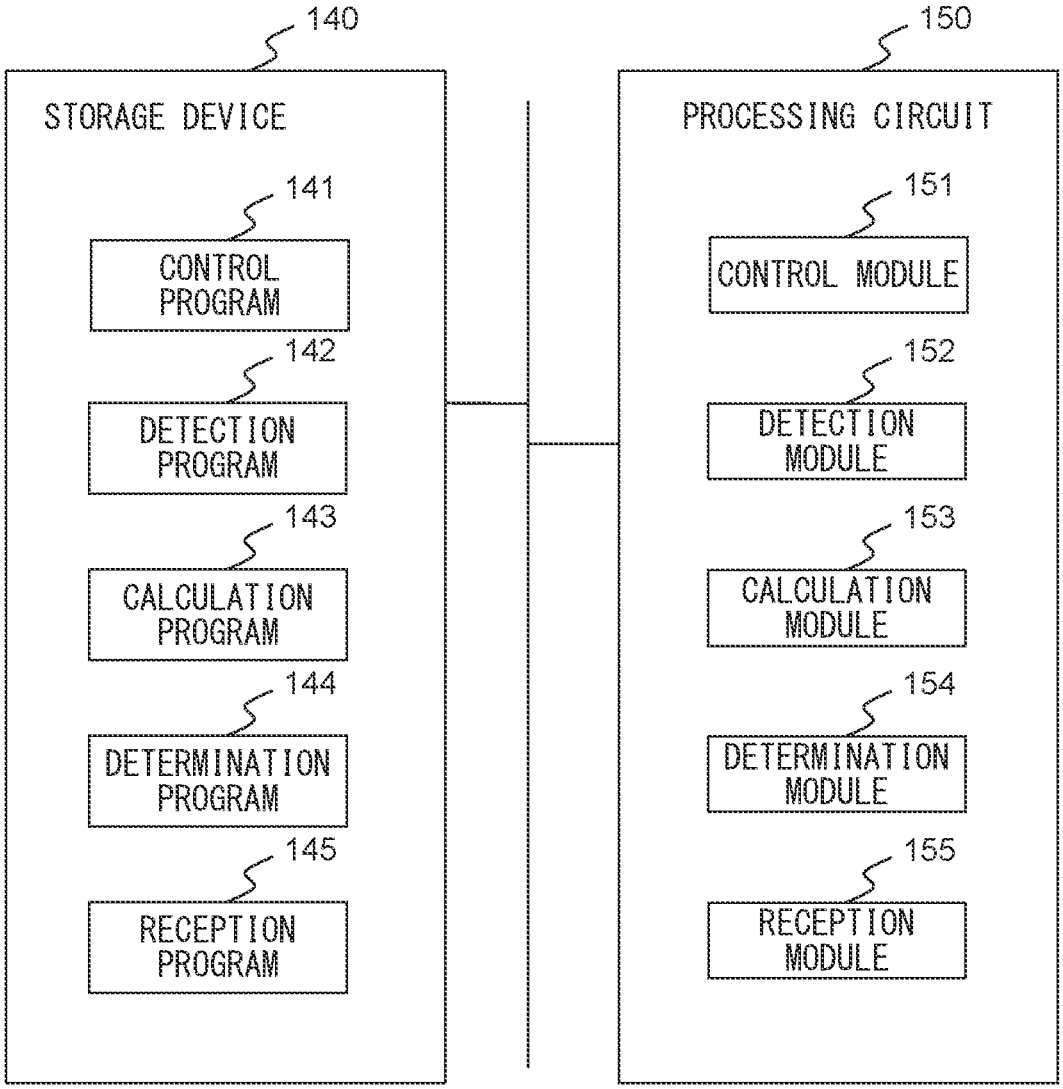
FIG. 4 is a diagram illustrating schematic configurations of a storage device 140 and a processing circuit 150.

FIG. 4 is a diagram illustrating schematic configurations of the storage device 140 and the processing circuit 150.

As shown in FIG. 4, each program such as a control program 141, a detection program 142, a calculation program 143, a determination program 144, and a reception program 145, etc., is stored in the storage device 140. Each of these programs is a functional module implemented by software operating on a processor. The processing circuit 150 reads each program stored in the storage device 140 and operates according to the read programs, to function as a control module 151, a detection module 152, a calculation module 153, a determination module 154, and a reception module 155.

Figure 5:
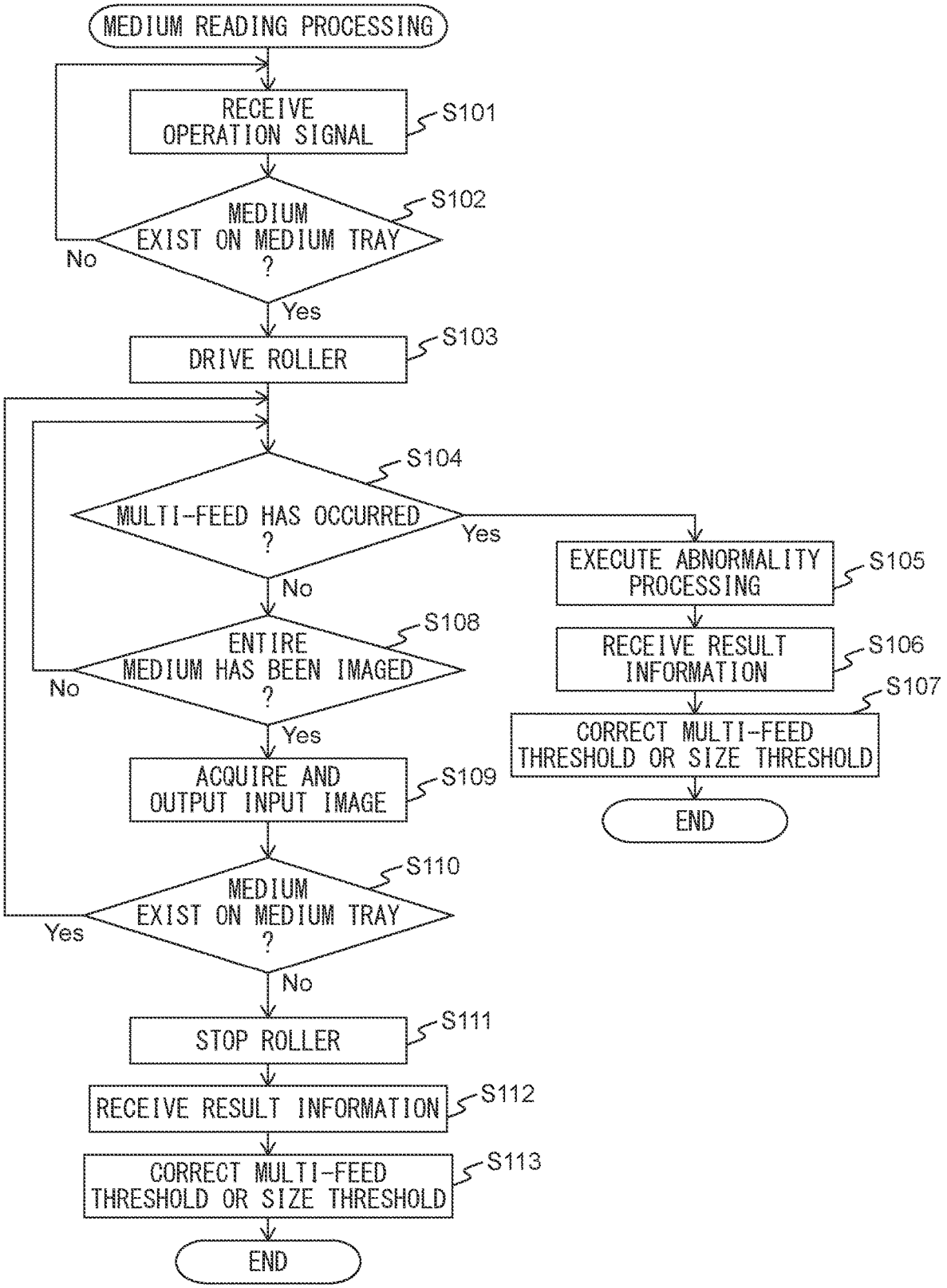
FIG. 5 is a flowchart illustrating an operation example of a medium reading processing.

FIG. 5 is a flowchart illustrating an operation example of a medium reading processing.

Referring to the flowchart illustrated in FIG. 5, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140.

First, the control module 151 stands by until an instruction to read a medium is input by the user by use of the operation device 105 or the information processing apparatus, and an operation signal instructing to read the medium is received from the operation device 105 or the interface device 132 (step S101).

Next, the control module 151 acquires the first medium signal from the first medium sensor 111, and determines whether or not the medium is placed on the medium tray 103 based on the acquired first medium signal (step S102). When a medium is not placed on the medium tray 103, the control module 151 returns the process to step S101 and stands by until newly receiving an operation signal from the operation device 105 or the interface device 132.

On the other hand, when the medium is placed on the medium tray 103, the control module 151 drives the motor for moving the medium tray 103 to move the medium tray 103 to a position capable of feeding the medium. The control module 151 drives the motor 131 to rotate the pick roller 112, the feed roller 113, the brake roller 114, and the first to eighth conveyance rollers 117*a* to 117*h* to feed and convey the medium placed on the mounting table 103 (step S103).

Next, the control module 151 determines whether or not it is determined that the multi-feed of the medium has occurred in multi-feed determination processing executed in parallel with the medium read processing (step S104). In the multi-feed determination processing, the determination module 154 determines whether or not the multi-feed of the medium has occurred by comparing the value based on the ultrasonic signal with the multi-feed threshold. Further, the determination module 154 changes the multi-feed threshold according to whether or not the size of the area in which the signal value of the ultrasonic signal is within the predetermined range in the conveyed medium is equal to or more than the size threshold. Details of the multi-feed determination processing will be described later.

When it is determined that the multi-feed of the medium has occurred in the multi-feed determination process, the control module 151 executes an abnormality processing (step S105). The control module 151 stops the motor 131 to stop feeding and conveying the medium by the conveying roller, as the abnormality processing. Further, the control module 151 displays information indicating that the multi-feed of the medium has occurred on the display device 106 or transmits the information to the information processing apparatus via the interface device 132, to notify the user, as the abnormal processing. The control module 151 may stop the medium reading processing after ejecting the currently conveyed medium, as an abnormal process. Further, the control module 151 may drive the motor 131, to control the conveying roller so as to re-feed after returning the medium once to the medium tray 103 by reverse feeding the medium, as an abnormality process. Thus, the user does not need to re-place the medium on the medium tray 103 and re-feed, and thereby, the control module 151 can improve the convenience of the user.

Next, the reception module 155 receives the result information indicating whether or not the determination result of the multi-feed of the medium by the determination module 154 is correct, from the user (step S106). The reception module 155 receives result information input by the user using the operation device 105 or the information processing apparatus, from the operation device 105 or the interface device 132. The reception module 155 stores the received result information in the storage device 140.

Next, the determination module 154 corrects a determination sensitivity in the multi-feed determination processing, based on the result information (step S107), and ends series of steps.

The determination module 154 decreases the determination sensitivity when the result information indicates that the determination result of the multi-feed of the medium was incorrect. The determination module 154 may correct the determination sensitivity based on the two or more result information received after the determination sensitivity is last updated. In that case, the determination module 154 decreases the determination sensitivity when the number or the ratio of the result information indicating that the determination result of the multi-feed of the medium was incorrect, among the most recent predetermined number of the result information, exceeds a predetermined threshold. Thus, the medium conveying apparatus 100 can appropriately set the determination sensitivity for a specific type of medium frequently conveyed by itself.

For example, the determination module 154 corrects the multi-feed threshold as the determination sensitivity. In this case, the determination module 154 decreases the multi-feed threshold (a first multi-feed threshold and/or a second multi-feed threshold to be described later) when the result information indicates that the determination result of the multi-feed of the medium was incorrect. Further, the determination module 154 may correct the size threshold, as the determination sensitivity. In that case, the determination module 154 increases the size threshold when the result information indicates that the determination result of the multi-feed of the medium was incorrect. Thus, the medium conveying apparatus 100 can suppress erroneous determination that the multi-feed of the medium has occurred.

The determination module 154 may correct the determination sensitivity, so as to increase the determination sensitivity, when the result information indicates that the determination result of the multi-feed of the medium was correct. However, the determination module 154 may frequently erroneously determine that the multi-feed of the medium has occurred, when the determination sensitivity is too high. Thus, the settable range may be set in each determination sensitivity.

Further, the predetermined threshold may be set by the user. Thus, the medium conveying apparatus 100 can change which of reliably detecting the occurrence of the multi-feed or reducing the processing time of the medium reading processing is emphasized, according to the user's application. Therefore, the medium conveying apparatus 100 can improve the convenience of the user. Further, the medium conveying apparatus 100 may transmit the result information or the corrected determination sensitivity to another medium conveying apparatus, and the other medium conveying apparatus may correct the determination sensitivity of itself based on the information. Thus, the medium conveying apparatus 100 can share the determination result of the multi-feed with other medium conveying apparatus to further improve the determination accuracy of the multi-feed of the medium.

On the other hand, in step S104, when it is determined that the multi-feed of the medium has not occurred in the multi-feed determination processing, the control module 151 determines whether or not the entire medium has been imaged (step S108). The control module 151, for example, determines whether or not the rear end of the medium has passed through the position of the second medium sensor 115 based on the second medium signal received from the second medium sensor 115. The control module 151 acquires the second medium signal periodically from the second medium sensor 115. The control module 151 determines that the rear end of the medium has passed through the position of the second medium sensor 115 when the signal value of the second medium signal changes from a value indicating that a medium exists to a value indicating that there is no medium. The control module 151 determines that the rear end of the medium passes through the imaging position of the imaging device 119, and the entire medium has been imaged when a predetermined time has elapsed after the rear end of the medium passed through the position of the second medium sensor 115. The control module 151 may determine the entire conveyed medium has been imaged when a predetermined time has elapsed since the start of feeding of the medium.

When the entire conveyed medium has not been imaged, the control module 151 returns the process to step S104 and repeats the processes in step S104 to S108.

On the other hand, when the entire conveyed medium has been imaged, the control module 151 acquires the input image from the imaging device 119, and outputs by transmitting the acquired input image to the information processing apparatus via the interface device 132 (step S109).

Next, the control module 151 determines whether or not a medium remains on the medium tray 103 based on the first medium signal acquired from the first medium sensor 111 (step S110). When a medium remains on the medium tray 103, the control module 151 returns the process to step S104 and repeats the processes in steps S104 to S110.

On the other hand, when no medium remains on the medium tray 103, the control module 151 stops the motor 131 to stop the pick roller 112, the feed roller 113, the brake roller 114, and the first to eighth conveyance rollers 117*a* to 117*h* (step S111).

Next, in the same manner as in step S106, the reception module 155 receives the result information indicating whether or not the determination result of the multi-feed of the medium by the determination module 154 is correct, from the user (step S112). The reception module 155 stores the received result information in the storage device 140.

Next, the determination module 154 corrects the determination sensitivity at each position in the medium based on the result information (step S113), and ends series of steps.

The determination module 154 increases the determination sensitivity when the result information indicates that the determination result of the multi-feed of the medium was incorrect. The determination module 154 may correct the determination sensitivity based on the two or more result information received after the determination sensitivity is last updated. In that case, the determination module 154 increases the determination sensitivity when the number or the ratio of the result information indicating that the determination result of the multi-feed of the medium was incorrect, among the most recent predetermined number of the result information, exceeds the predetermined threshold. Thus, the medium conveying apparatus 100 can appropriately set the determination sensitivity for a specific type of medium frequently conveyed by itself.

For example, the determination module 154 corrects the multi-feed threshold as the determination sensitivity. In this case, the determination module 154 increases the multi-feed threshold when the result information indicates that the determination result of the multi-feed of the medium was incorrect. Further, the determination module 154 may correct the size threshold, as the determination sensitivity. In that case, the determination module 154 decreases the size threshold when the result information indicates that the determination result of the multi-feed of the medium was incorrect. Thus, the medium conveying apparatus 100 can suppress the determination that the multi-feed of the medium has not occurred even though the multi-feed has occurred.

Either or both of steps S106 to S107 and steps S112 to S113 may be omitted.

Figure 6:
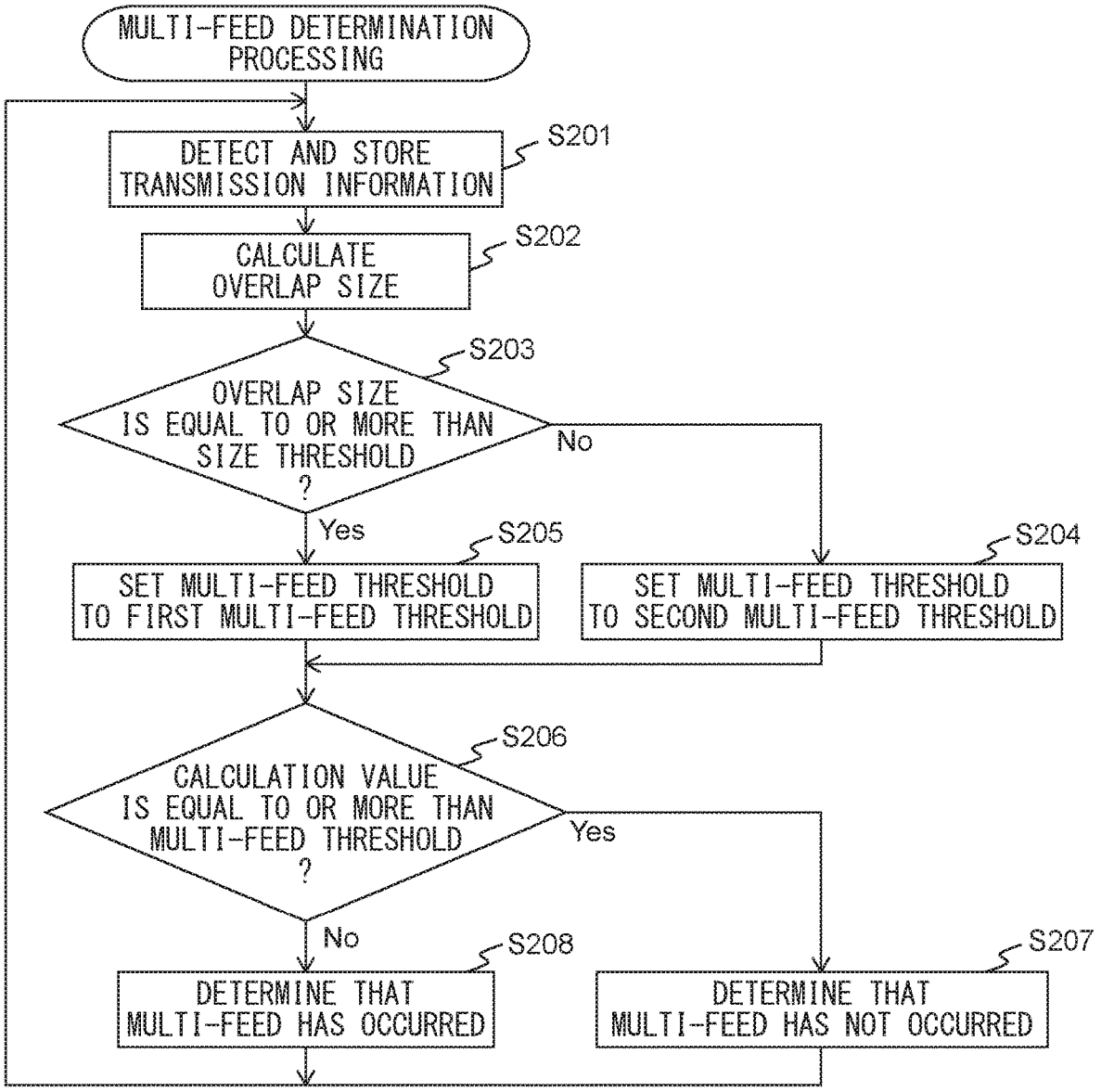
FIG. 6 is a flowchart illustrating an operation example of a multi-feed determination processing.

FIG. 6 is a flowchart illustrating an operation example of the multi-feed determination processing of the medium conveying apparatus 100.

Referring to the flowchart illustrated in FIG. 6, an operation example of the multi-feed determination processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 6 is executed during medium conveyance.

First, the detection module 152 receives the ultrasonic signal from the ultrasonic sensor 116. The detection module 152 detects the transmission information indicated in the received ultrasonic signal as the transmission information of the ultrasonic wave transmitted through the medium at a plurality of positions in the medium conveyed by the conveying roller, and stores the transmission information in the storage device 140 in association with the present time (step S201).

Next, the calculation module 153 calculates a size of an area in which the transmission information detected by the detection module 152 is within a predetermined range in the conveyed medium, as the overlap size in which the overlap of the medium has occurred (step S202). The calculation module 153 determines that the overlap of the medium has occurred at a position where the calculated value based on the transmission information is less than the first multi-feed threshold. The calculation module 153 calculates a statistical value (an average value, a median value, a maximum value or a minimum value) of the transmission information detected within a predetermined period before and after each transmission information is detected, as the calculated value. The calculation module 153 may use each transmission information itself, as the calculated value. For example, the first multi-feed threshold is set to a value between the transmission information detected when one PPC (Plain Paper Copier) sheet is conveyed and the transmission information detected when two PPC papers are conveyed. In particular, the first multi-feed threshold is set to a value between the transmission information detected when one PPC paper is conveyed and the transmission information detected when two thin papers are conveyed. The calculation module 153 sets the overlap size to 0 when the calculated value based on the latest transmission information is equal to or more than the first multi-feed threshold. On the other hand, the calculation module 153 refers to the transmission information stored in the storage device 140 and calculates a value acquired by multiplying the conveyance speed of the medium by the latest continuous time in which the state where the calculated value is less than the first multi-feed threshold is continuous, as the overlap size, when the calculated value based on the latest transmission information is less than the first multi-feed threshold.

The calculation module 153 calculates the overlap size in the medium conveying direction A2 for each ultrasonic sensor 116 when the number of the ultrasonic sensors 116 is plural. The calculation module 153 may calculate the size at which the overlap of the medium has occurred in the width direction A4, in addition to or instead of the size at which the overlap of the medium has occurred in the medium conveying direction A2, as the overlap size. In that case, the calculation module 153 calculates the overlap size in the width direction A4 based on the location position of the ultrasonic sensor 116 which outputs the transmission information which is less than the first multi-feed threshold.

Next, the determination module 154 determines whether or not the overlap size calculated by the calculation module 153 is equal to or more than the size threshold (step S203). The size threshold is set to, for example, a size of a photograph adhered to a general resume, or a value acquired by adding a margin to a size of the postage stamp or the revenue stamp (e.g., 50 mm).

When the overlap size is less than the size threshold, the determination module 154 sets the multi-feed threshold to a second multi-feed threshold (step S204). The second multi-feed threshold is a value between the transmission information detected when a single PPC paper is conveyed and the transmission information detected when two PPC papers are conveyed, and is set to a value smaller than the first multi-feed threshold. In particular, the second multi-feed threshold is set to a value between the transmission information detected when two thin papers are conveyed and the transmission information detected when two PPC papers are conveyed.

On the other hand, when the overlap size is equal to or more than the size threshold, the determination module 154 changes the multi-feed threshold from the second multi-feed threshold to the first multi-feed threshold (step S205).

Thus, the determination module 154 changes the multi-feed threshold according to the overlap size. In particular, the determination module 154 changes the multi-feed threshold according to whether or not the overlap size is equal to or more than the size threshold. The determination module 154 may set the multi-feed threshold to any of the three or more values. In that case, the determination module 154 changes the multi-feed threshold so that the larger the overlap size, the larger the multi-feed threshold. Thus, the determination module 154 can change the multi-feed threshold more flexibly.

Next, the determination module 154 calculates a calculated value based on the transmission information, and determines whether or not the calculated value is equal to or more than the multi-feed threshold (step S206). The determination module 154 reads the transmission information detected by the detection module 152 within the latest predetermined period from the storage device 140, and calculates a statistical value (an average value, a median value, a maximum value or a minimum value) of the read transmission information, as the calculated value. The determination module 154 may use the latest transmission information itself, as the calculated value.

When the calculated value is equal to or more than the multi-feed threshold, the determination module 154 determines that the multi-feed of the medium has not occurred (step S207), and returns the process to step S201. In particular, the determination module 154 determines that an adhered object is adhered to the conveyed medium to determine that the multi-feed of the medium has not occurred when the overlap size is less than the size threshold and the calculated value is equal to or more than the multi-feed threshold (the second multi-feed threshold), even when the calculated value is less than the first multi-feed threshold. Thus, the determination module 154 can suppress erroneous determination that the multi-feed of the medium has occurred when the medium to which a medium of the small size is adhered is conveyed.

On the other hand, when the calculated value is less than the multi-feed threshold, the determination module 154 determines that the multi-feed of the medium has occurred (step S208), and returns the process to step S201. In this case, it is determined that a multi-feed has occurred in step S104 of FIG. 5, and the abnormality processing is executed in step S105.

Thus, the determination module 154 determines whether or not the multi-feed of the medium has occurred by comparing the calculated value based on the transmission information detected by the detection module 152 with the multi-feed threshold. In particular, the calculation module 153 updates the overlap size each time the detection module 152 detects the transmission information. The determination module 154 compares the calculated value based on the transmission information with the multi-feed threshold each time the detection module 152 detects the transmission information, and changes the multi-feed threshold when the updated overlap size is equal to or more than the size threshold. Thus, the determination module 154 determines whether or not the multi-feed of the medium has occurred in real time during the conveyance of the medium, and can immediately stop the conveyance of the medium when the multi-feed of the medium occurs. Therefore, the medium conveying apparatus 100 can suppress the occurrence of damage to the medium.

The transmission information may indicate the magnitude of a shift of a phase of the ultrasonic wave received by the ultrasonic receiver 116*b* with respect to a phase of the ultrasonic wave transmitted by the ultrasonic transmitter 116*a*, instead of the magnitude of the ultrasonic wave received by the ultrasonic receiver 116*b*. The shift of the phase of the ultrasonic wave passing through the media when the media overlaps, is larger than the shift of the phase when a medium does not overlap. Therefore, when the magnitude of the shift of the phase of the ultrasonic wave is used as the transmission information, the medium conveying apparatus 100 changes the multi-feed threshold so that the larger the overlap size, the smaller the multi-feed threshold.

Further, when the state in which the calculated value is less than the multi-feed threshold is equal to or less than a predetermined time, the determination module 154 may determine that the state occurs by an external noise or a bubble in the adhered object, and may exclude the area corresponding to the state from a target area in which the multi-feed is determined. Thus, the determination module 154 can reduce the influence of noise in the multi-feed determination.

Figure 7A:
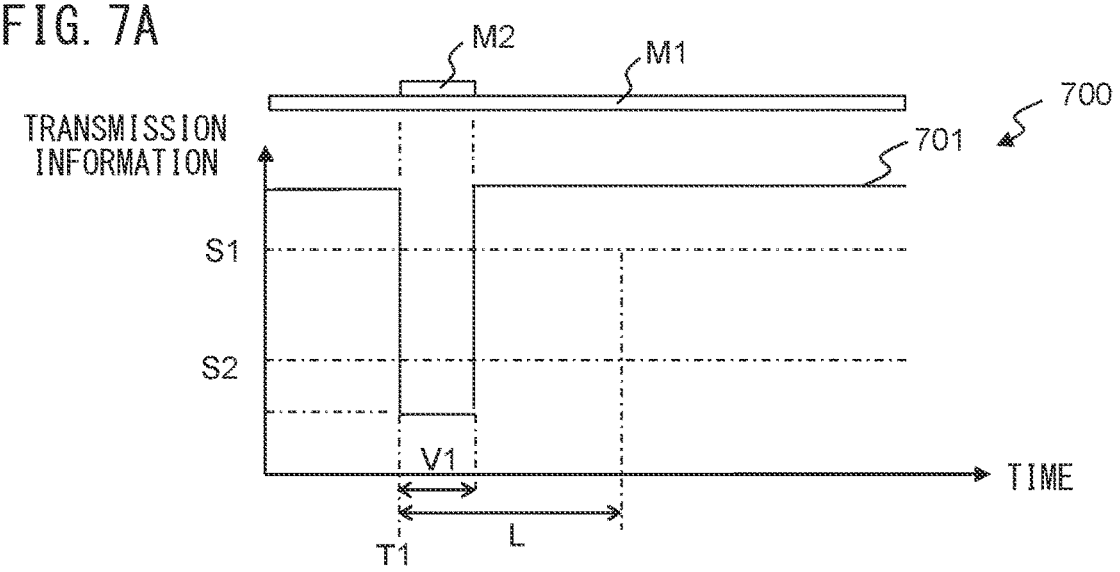
FIG. 7A is a schematic diagram for illustrating the technical significance.
Figure 7B:
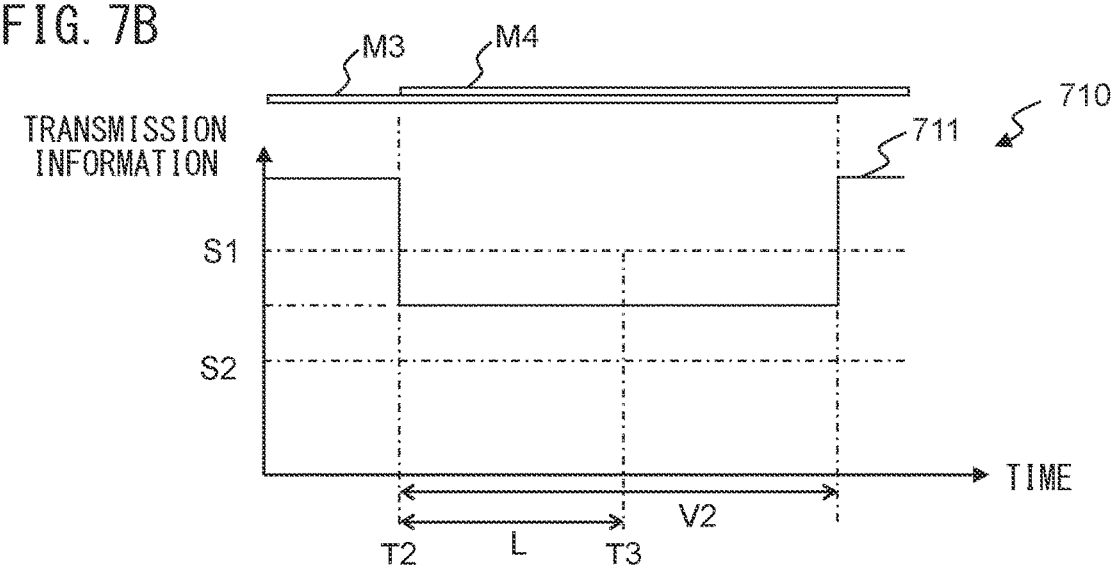
FIG. 7 B is a schematic diagram for illustrating the technical significance.
FIG. 7C is a schematic diagram for illustrating the technical significance.
Figure 7C:
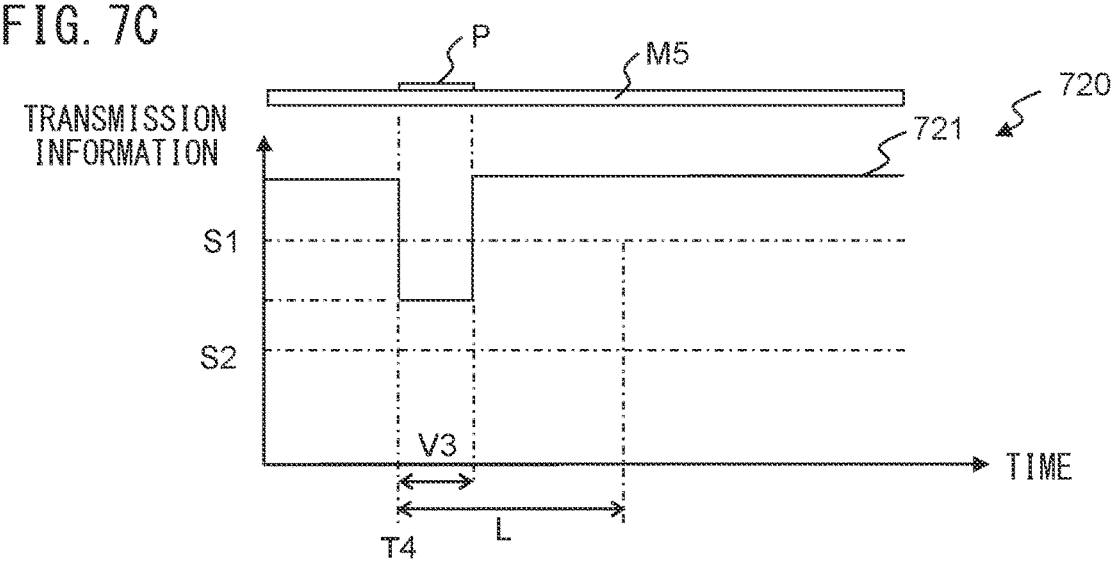

FIGS. 7A, 7B and 7C are schematic diagrams for illustrating the technical significance of changing the multi-feed threshold according to the overlap size when determining whether or not the multi-feed of the medium has occurred based on the transmission information.

FIGS. 7A, 7B and 7C are graphs 700, 710 and 720 that indicate characteristics of the transmission information (the magnitude of the ultrasonic wave). The horizontal axes of the graphs 700, 710 and 720 indicate time, and the vertical axes indicate the transmission information. In the graphs 700, 710 and 720, values S1 and S2 indicate the first multi-feed threshold and the second multi-feed threshold, respectively, and a length L indicates the size threshold.

In the graph 700, a solid line 701 indicates the characteristics of the transmission information when a PPC paper M1 and a PPC paper M2 are conveyed in an overlapped manner. The PPC paper M1 is a normal paper such as A4 size, and the PPC paper M2 is a small paper having a size such as a receipt or a business card. Although the length of a portion V1 where the PPC paper M1 and the PPC paper M2 overlap is smaller than the size threshold L, the transmission information in the portion V1 where the PPC paper M1 and the PPC paper M2 overlap is smaller than the second multi-feed threshold S2. Therefore, at a time T1 when the front end of the PPC paper M2 overlaps the PPC paper M1 and passes through the position of the ultrasonic sensor 116, it is correctly determined that the multi-feed of the medium has occurred.

In the graph 710, the solid line 711 indicates the characteristics of the transmission information when a thin paper M3 and a thin paper M4 are conveyed in an overlapped manner. The thin paper M3 and the thin paper M4 are normal paper such as A4 size. The amount of attenuation of the ultrasonic wave transmitted through the thin paper M3 and the thin paper M4 is smaller than the amount of attenuation of the ultrasonic wave transmitted through the PPC paper M1 and the PPC paper M2. Therefore, the transmission information in a portion V2 where the thin paper M3 and the thin paper M4 overlap is more than the transmission information in the portion V1 where the PPC paper M1 and the PPC paper M2 overlap, and has a value between the first multi-feed threshold S1 and the second multi-feed threshold S2. On the other hand, the length of the portion V2 where the thin paper M3 and the thin paper M4 overlap is equal to or more than the size threshold L. Therefore, it is not determined that the multi-feed of the medium has occurred at the time T2 when the front end of the thin paper M4 overlaps the thin paper M3 and passes through the position of the ultrasonic sensor 116. However, thereafter, at a time T3 at which the medium is conveyed by the size threshold L, the multi-feed threshold is changed to the first multi-feed threshold S1, and it is correctly determined that the multi-feed of the medium has occurred.

In the graph 720, the solid line 721 indicates the characteristics of the transmission information when the PPC paper M5 to which the adhered object P is adhered, is conveyed. The PPC paper M5 is a normal paper such as A4 size, and the adhered object P is a small medium such as a revenue stamp. There is no air layer between the PPC paper M5 and the adhered object P when the adhered object P is adhered to the PPC paper M5. Thus, the amount of attenuation of the ultrasonic wave is reduced as compared with the case where the adhered object P overlaps with the PPC paper M5 without being adhered to the PPC paper M5. Therefore, the transmission information in the portion V3 where the adhered object P is adhered to the PPC paper M5 is more than the transmission information in the portion V1 where the PPC paper M1 and the PPC paper M2 overlap, and has a value between the first multi-feed threshold S1 and the second multi-feed threshold S2. Therefore, it is not determined that the multi-feed of the medium has occurred at the time T4 when the portion to which the adhered object P is adhered in the PPC paper M5 passes through the position of the ultrasonic sensor 116. Further, since the length of the portion V3 to which the adhered object P is adhered in the PPC paper M5 is less than the size threshold L, the multi-feed threshold does not change from the second multi-feed threshold S2. Therefore, when the medium to which the small medium is adhered is conveyed, it is not determined that the multi-feed of the medium has occurred.

As shown in FIGS. 7A to 7C, the second multi-feed threshold S2 is appropriately set since the difference between the size of the ultrasonic wave transmitted through two PPC papers and the size of the ultrasonic wave transmitted through two thin papers or the portion to which an adhered object is adhered in a PPC paper, is sufficiently large. Similarly, the first multi-feed threshold S1 is appropriately set since the difference between the size of the ultrasonic wave transmitted through one PPC paper and the size of the ultrasonic wave transmitted through two thin papers or a portion to which an adhered object is adhered in a PPC paper, is sufficiently large. However, as shown in FIGS. 7B and 7C, since the difference between the size of the ultrasonic wave transmitted through two thin papers and the size of the ultrasonic wave transmitted through a portion to which an adhered object is adhered in a PPC paper is approximated, it is difficult to set an appropriate threshold therebetween. The determination module 154 can appropriately determine the multi-feed of the thin paper and the medium to which the adhered object is adhered, by utilizing the overlap size.

As described in detail above, the medium conveying apparatus 100 determines whether or not the multi-feed of the medium has occurred based on the transmission information of the ultrasonic waves detected at a plurality of positions in the conveyed medium, and changes the determination threshold according to the size of the overlap area in the medium. Thus, the medium conveying apparatus 100 can determine whether or not the multi-feed of the medium has occurred with higher accuracy.

In particular, the medium conveying apparatus 100 can suppress erroneously determining that the multi-feed has occurred, and stopping the conveyance of the medium when the medium to which the adhered object is adhered is conveyed. Thus, the medium conveying apparatus 100 can suppress an increase in the total time required for the medium reading processing. Further, the user does not need to re-place the medium on the medium tray 103 and cause the medium conveying apparatus 100 to re-convey it. Therefore, the medium conveying apparatus 100 can improve the convenience of the user.

In general, the size of a label or a small size paper piece, etc., adhered to the medium is sufficiently smaller than the size of the medium itself. Therefore, the medium conveying apparatus 100 can appropriately determine the multi-feed of the thin paper and the medium to which the adhered object is adhered, by utilizing the size of the overlap size.

Further, the medium conveying apparatus 100 changes the multi-feed threshold according to the overlap size, without omitting determining whether or not the multi-feed of the medium has occurred, when the overlap size is small. Therefore, the medium conveying apparatus 100 can detect the occurrence of the multi-feed of the medium, for example, when the PPC paper, etc., is conveyed, even when the small medium, such as a business card, a receipt, etc., is conveyed in an overlapped manner.

Figure 8:
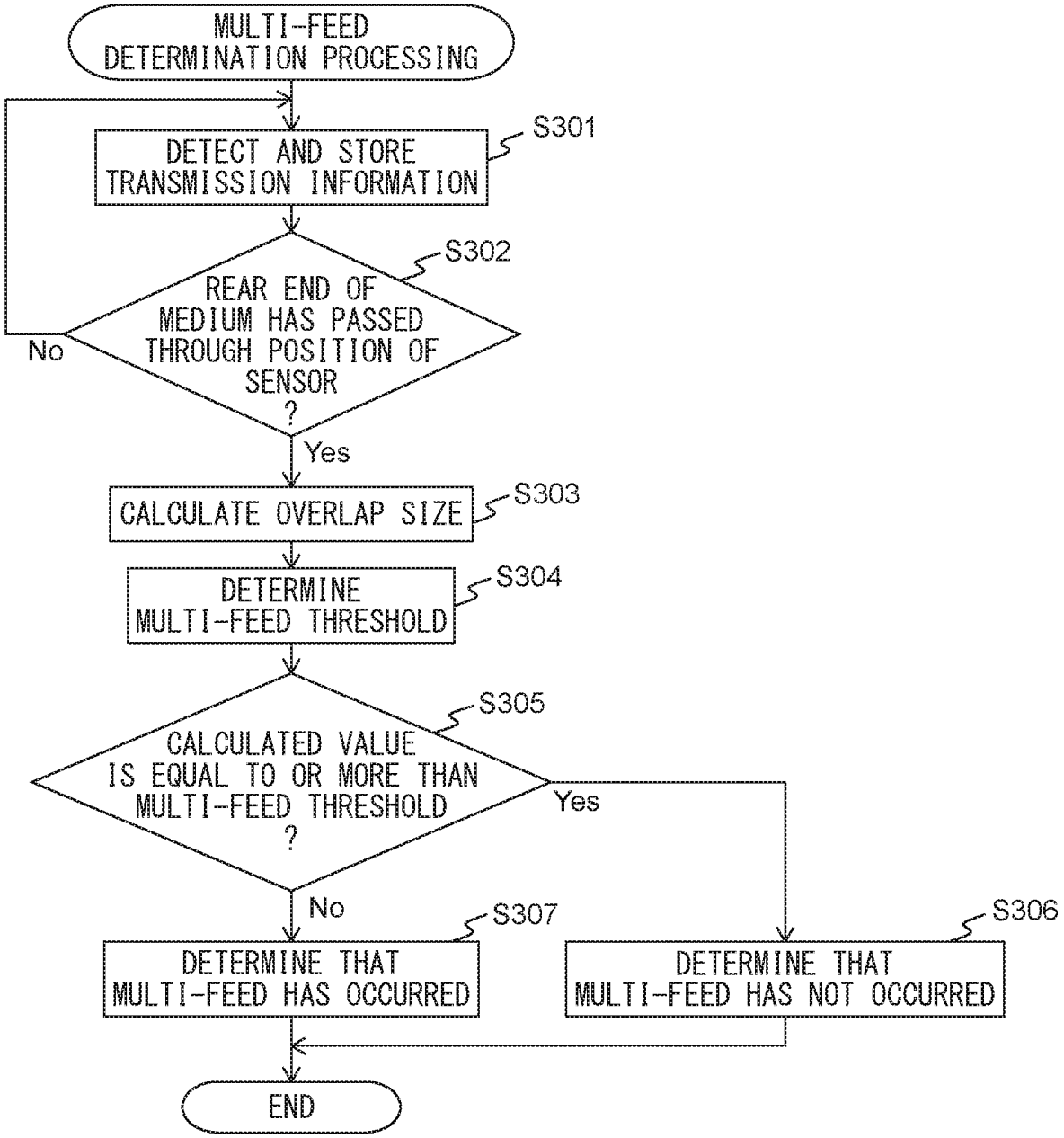
FIG. 8 is a flowchart illustrating an operation example of another multi-feed determination processing.

FIG. 8 is a flowchart illustrating an operation example of the multi-feed determination process according to another embodiment.

The flowchart shown in FIG. 8 is performed instead of the flowchart shown in FIG. 6. The operation flow illustrated in FIG. 6 is executed each time the medium is conveyed.

First, in the same manner as in step S201 of FIG. 6, the detection module 152 detects the transmission information indicated in the ultrasonic signal as the transmission information at a plurality of positions in the medium, and stores the transmission information in the storage device 140 in association with the present time (step S301).

Next, the detection module 152 determines whether or not the rear end of the medium has passed through the position of the ultrasonic sensor 116 (step S302). The control module 151, in the same manner as in step S108 of FIG. 5, determines whether or not the rear end of the medium has passed through the position of the second medium sensor 115. The control module 151 determines that the rear end of the medium has passed through the position of the ultrasonic sensor 116 when a predetermined time has elapsed after the rear end of the medium passed through the position of the second medium sensor 115. When the rear end of the medium has not yet passed the position of the ultrasonic sensor 116, the detection module 152 returns the process to step S301 and repeats the processes in steps S301 to S302.

On the other hand, when the rear end of the medium has passed through the position of the ultrasonic sensor 116, the calculation module 153 calculates the size of the area in which the transmission information detected by the detection module 152 is within the predetermined range in the conveyed medium as the overlap size (step S303). The calculation module 153 refers to the transmission information stored in the storage device 140 so far, and calculates a value acquired by multiplying the conveyance speed of the medium by the maximum time in which the state where the transmission information is less than the first multi-feed threshold is continuous, as the overlap size.

Next, the determination module 154 determines the multi-feed threshold based on the overlap size calculated by the calculation module 153 (step S304). The determination module 154 sets the second multi-feed threshold as the multi-feed threshold when the overlap size is less than the size threshold, and sets the first multi-feed threshold as the multi-feed threshold when the overlap size is equal to or more than the size threshold. The determination module 154 may set the multi-feed threshold to any of the three or more values. In that case, the determination module 154 sets the multi-feed threshold so that the larger the overlap size, the larger the multi-feed threshold. Thus, the determination module 154 can set the multi-feed threshold more flexibly.

Next, the determination module 154 refers to the transmission information stored in the storage device 140, calculates the calculated value based on the transmission information for each transmission information detected by the detection module 152 in a fixed period, and determines whether or not the calculated values are equal to or more than the multi-feed threshold (step S305).

When all the calculated values are equal to or more than the multi-feed threshold, the determination module 154 determines that the multi-feed of the medium has not occurred (step S306), and ends the series of steps. In particular, even when any of the calculated value is less than the first multi-feed threshold, when the overlap size is less than the size threshold and the calculated value (which is less than the first multi-feed threshold) is equal to or more than the multi-feed threshold (the second multi-feed threshold), the determination module 154 determines that an adhered object is adhered to the conveyed medium to determine that the multi-feed of the medium has not occurred. Thus, the determination module 154 can suppress erroneous determination that the multi-feed of the medium has occurred when the medium to which a medium of the small size is adhered is conveyed.

On the other hand, when any of the calculated values is less than the multi-feed threshold, the determination module 154 determines that the multi-feed of the medium has occurred (step S307), and ends the series of steps. In this case, it is determined that a multi-feed has occurred in step S104 of FIG. 5, and the abnormality processing is executed in step S105.

Thus, the calculation module 153 calculates the overlap size after the detection of the transmission information by the detection module 152 is completed. The determination module 154 determines the multi-feed threshold based on the overlap size, and compares the calculated value based on the transmission information detected by the detection module 152 at a plurality of positions with the determined multi-feed threshold. Thus, the determination module 154 can appropriately determine whether or not the multi-feed of the medium has occurred while reducing a calculation amount during the conveyance of the medium to reduce the processing load of the multi-feed determination processing.

As described in detail above, the medium conveying apparatus 100 can determine whether or not the multi-feed of the medium has occurred with higher accuracy even when the multi-feed threshold is determined after the rear end of the medium has passed through the position of the ultrasonic sensor 116.

Figure 9:
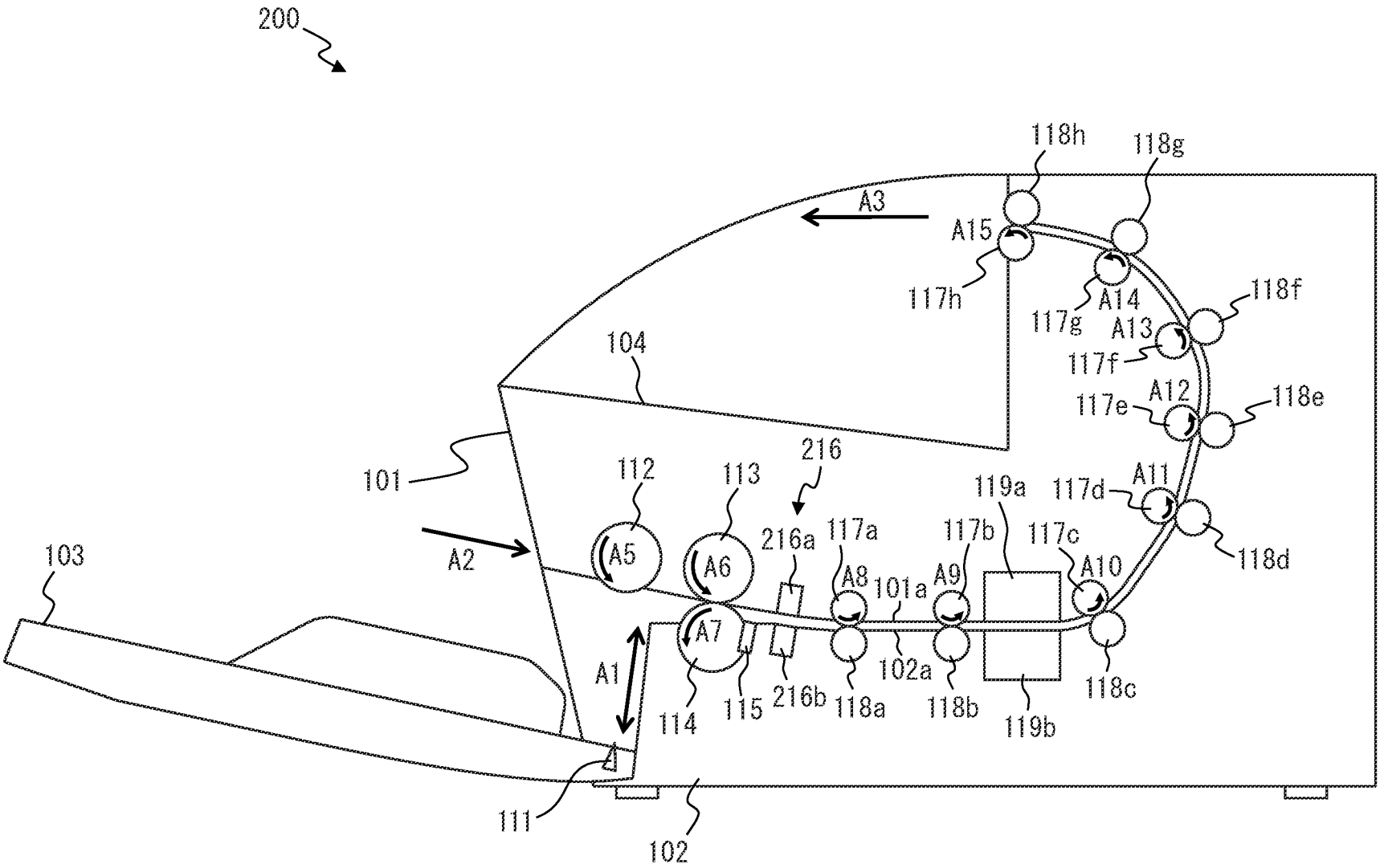
FIG. 9 is a diagram for illustrating a conveyance path inside another medium conveying apparatus 200.

FIG. 9 is a diagram for illustrating a conveyance path inside the medium conveying apparatus 200 according to another embodiment.

As shown in FIG. 9, the medium conveying apparatus 200 includes the respective portions of the medium conveying apparatus 100. However, the medium conveying apparatus 200 includes a thickness sensor 216 instead of the ultrasonic sensor 116.

The thickness sensor 216 is located on the downstream side of the feed roller 113 and the brake roller 114 and on the upstream side of the first to eighth conveyance rollers 117*a* to 117*h* and the first to eighth driven rollers 118*a* to 118*h*. The thickness sensor 216 includes a light emitter 216*a* and a light receiver 216*b*. The light emitter 216*a* and the light receiver 216*b* are located close to the conveyance path of the medium in such a way as to face one another with the conveyance path in between. The light emitter 216*a* emits light (infrared light or visible light) toward the light receiver 216*b*. On the other hand, the light receiver 216*b* receives the light emitted by the light emitter 216*a*, and generates and outputs a thickness signal being an electric signal corresponding to the intensity of the received light. When a medium exists at the position of the thickness sensor 216, the light emitted by the light emitter 216*a* is attenuated by the medium, and the greater the thickness of the medium, the greater the amount of attenuation. For example, the thickness sensor 216 generates the thickness signal such that the greater the thickness of the medium, the greater the signal value. The thickness signal indicates the thickness information of the medium at a plurality of positions in the conveyed medium by the conveying roller. The number of the thickness sensor 216 is not limited to one, and may be plural. In that case, a plurality of thickness sensors 216 are spaced and located along in the width direction A4.

A reflected light sensor, a pressure sensor or a mechanical sensor may be used as the thickness sensor 216. The reflected light sensor includes a pair of light emitter and light receiver provided on one side with respect to a conveyance path of the medium and a pair of light emitter and light receiver provided on the other side. The reflected light sensor detects a distance between each pair and each surface of the medium, based on a time from when one pair emits light to one surface of the medium to when it receives the reflected light and a time from when the other pair emits light to the other surface of the medium to when it receives the reflected light. The reflected light sensor generates a thickness signal which indicates a subtracted value acquired by subtracting each detected distance from a distance between the two pairs, as the thickness information. The pressure sensor detects a pressure which changes according to the thickness of the medium, and generates a thickness signal which indicates the detected pressure, as the thickness information. The mechanical sensor detects a movement amount of a contact member such as a roller in contact with the medium, and generates a thickness signal which indicates the detected movement amount, as the thickness information.

Similarly to the medium conveying apparatus 100, the medium conveying apparatus 200 executes the medium read processing illustrated in FIG. 5 and the multi-feed determination processing illustrated in FIG. 6.

However, in step S107 of FIG. 5, the determination module 154 increases the multi-feed threshold when the result information indicates that the determination result of the multi-feed of the medium was incorrect. Further, in step S113, the determination module 154 decreases the multi-feed threshold when the result information indicates that the determination result of the multi-feed of the medium was incorrect.

Further, in step S201 of FIG. 6, the detection module 152 receives the thickness signal from the thickness sensor 216. The detection module 152 detects the thickness information indicated in the received thickness signal as the thickness information of the medium at a plurality of positions in the medium conveyed by the conveying roller, and stores it in the storage device 140 in association with the current time.

Further, in step S202, the calculation module 153 calculates the size of the area in which the thickness information detected by the detection module 152 is within a predetermined range in the conveyed medium as the overlap size. The calculation module 153 determines that the overlap of the media has occurred at a position at which the thickness information is more than the first multi-feed threshold. The first multi-feed threshold is set to, for example, a value between the thickness information detected when one PPC paper is conveyed and the thickness information detected when two PPC papers are conveyed. In particular, the first multi-feed threshold is set to a value between the thickness information detected when one PPC paper is conveyed and the thickness information detected when two thin papers are conveyed. On the other hand, the second multi-feed threshold is set to a value between the thickness information detected when one PPC paper is conveyed and the thickness information detected when two PPC papers are conveyed, and is set to a value more than the first multi-feed threshold. In particular, the second multi-feed threshold is set to a value between the thickness information detected when two thin papers are conveyed and the thickness information detected when two PPC papers are conveyed. The calculation module 153 sets the overlap size to 0 when the latest thickness information is equal to or less than the first multi-feed threshold. On the other hand, the calculation module 153 refers to the thickness information stored in the storage device 140 and calculates a value acquired by multiplying the conveyance speed of the medium by the latest continuous time in which the state where the thickness information is more than the first multi-feed threshold is continuous, as the overlap size, when the latest thickness information is more than the first multi-feed threshold.

The calculation module 153 calculates the overlap size in the medium transport direction A2 for each thickness sensor 216 when the number of the thickness sensors 216 is plural. The calculation module 153 may calculate the size at which the overlap of the medium has occurred in the width direction A4, in addition to or instead of the size at which the overlap of the medium has occurred in the medium conveying direction A2, as the overlap size. In that case, the calculation module 153 calculates the overlap size in the width direction A4 based on the location position of the thickness sensor 216 which outputs the information which is more than the first multi-feed threshold.

Further, in step S206, the determination module 154 calculates a calculated value based on the thickness information detected by the detection module 152 within the latest predetermined period, and determines whether or not the calculated value is equal to or less than the multi-feed threshold. The determination module 154 calculates a statistical value (an average value, a median value, a maximum value or a minimum value) of the thickness information, as the calculated value. The determination module 154 may use the thickness information itself, as the calculated value. When the calculated value is equal to or less than the multi-feed threshold, in step S207, the determination module 154 determines that the multi-feed of the medium has not occurred. In particular, the determination module 154 determines that an adhered object is adhered to the conveyed medium to determine that the multi-feed of the medium has not occurred when the overlap size is less than the size threshold and the calculated value is equal to or less than the multi-feed threshold (the second multi-feed threshold), even when the calculated value is more than the first multi-feed threshold. On the other hand, when the calculated value is more than the multi-feed threshold, in step S208, the determination module 154 determines that the multi-feed of the medium has occurred.

Thus, the determination module 154 determines whether or not the multi-feed of the medium has occurred, by comparing the calculated value based on the thickness information detected by the detection module 152 with the multi-feed threshold. In particular, the calculation module 153 updates the overlap size each time the detection module 152 detects the thickness information. The determination module 154 compares the calculated value based on the thickness information with the multi-feed threshold each time the detection module 152 detects the thickness information, and changes the multi-feed threshold when the updated overlap size is equal to or more than the size threshold.

Figure 10A:
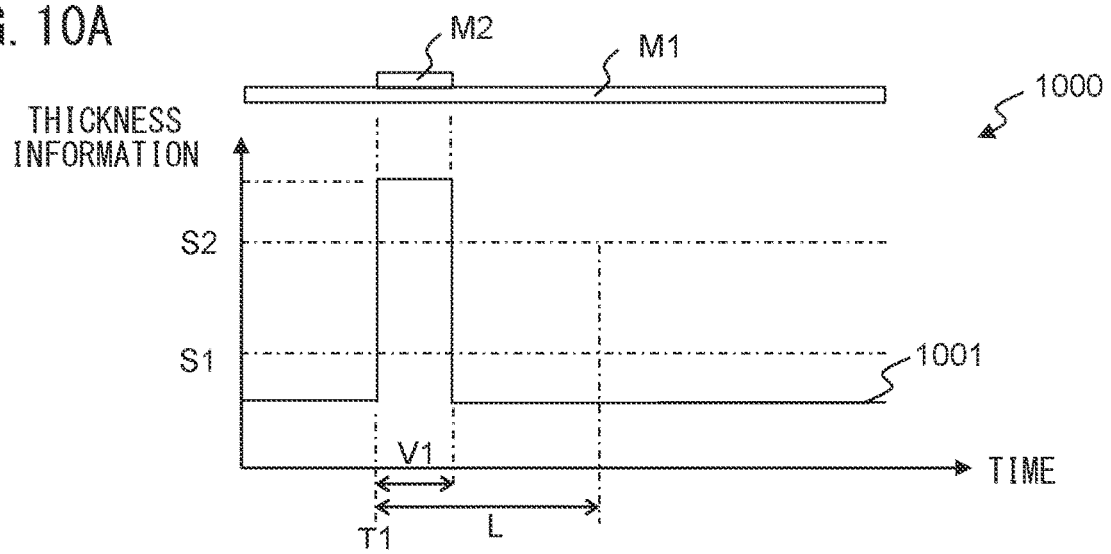
FIG. 10A is a schematic diagram for illustrating the technical significance.
Figure 10B:
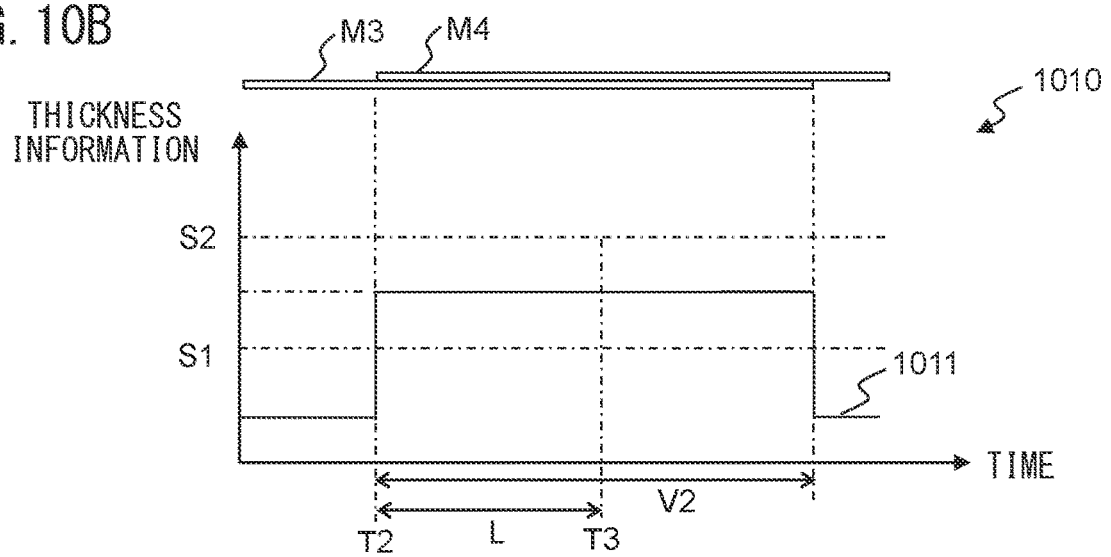
FIG. 10 B is a schematic diagram for illustrating the technical significance.
FIG. 10C is a schematic diagram for illustrating the technical significance.
Figure 10C:
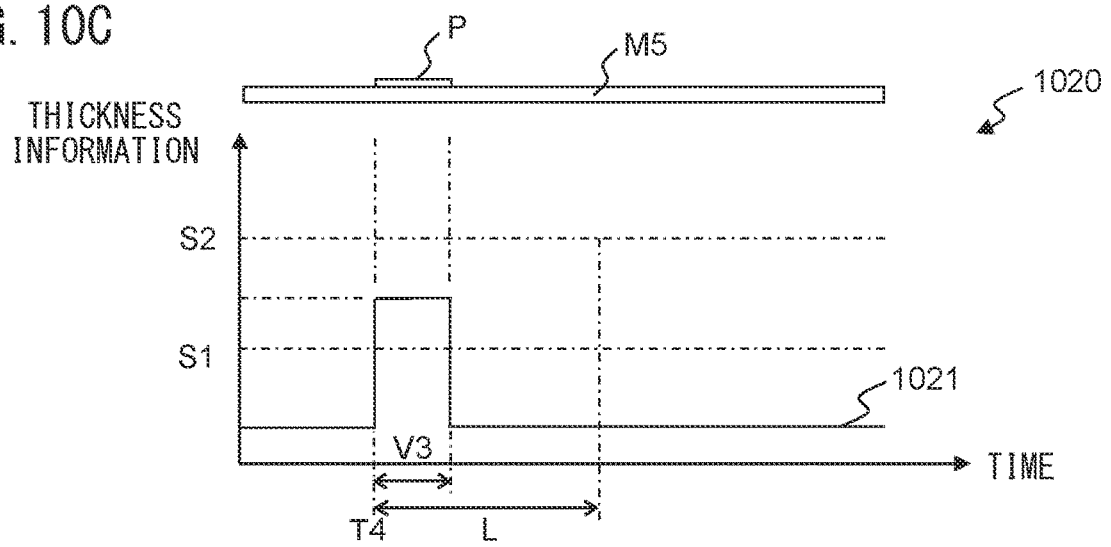

FIGS. 10A, 10B and 10C are schematic diagrams for illustrating the technical significance of changing the multi-feed threshold according to the overlap size when determining whether or not the multi-feed of the medium has occurred based on the thickness information.

FIGS. 10A, 10B and 10C are graphs 1000, 1010 and 1020 that indicate characteristics of the thickness information (the thickness of the medium). The horizontal axes of the graphs 1000, 1010 and 1020 indicate time, and the vertical axes indicate the value of the thickness information. In the graphs 1000, 1010 and 1020, values S1 and S2 indicate the first multi-feed threshold and the second multi-feed threshold, respectively, and a length L indicates the size threshold.

In the graph 1000, the solid line 1001 shows the characteristics of the thickness information when the PPC paper M1 and the PPC paper M2 are conveyed in an overlapped manner. Although the length of a portion V1 in which the PPC paper M1 and the PPC paper M2 overlap is less than the size threshold L, the thickness information in the portion V1 in which the PPC paper M1 and the PPC paper M2 overlap is more than the second multi-feed threshold S2. Therefore, at a time T1 when the front end of the PPC paper M2 overlaps the PPC paper M1 and passes through the position of the thickness sensor 216, it is correctly determined that the multi-feed of the medium has occurred.

In the graph 1010, the solid line 1011 shows the characteristics of the thickness information when the thin paper M3 and the thin paper M4 are conveyed in an overlapped manner. The thickness of the thin paper M3 and the thin paper M4 is smaller than the thickness of the PPC paper M1 and the PPC paper M2. Therefore, the thickness information in the portion V2 in which the thin paper M3 and the thin paper M4 overlap is less than the thickness information in the portion V1 in which the PPC paper M1 and the PPC paper M2 overlap, and has a value between the first multi-feed threshold S1 and the second multi-feed threshold S2. On the other hand, the length of the portion V2 in which the thin paper M3 and the thin paper M4 overlap is equal to or more than the size threshold L. Therefore, it is not determined that the multi-feed of the medium has occurred at the time T2 when the front end of the thin paper M4 overlaps the thin paper M3 and passes through the position of the thickness sensor 216. However, thereafter, at a time T3 at which the medium is conveyed by the size threshold L, the multi-feed threshold is changed to the first multi-feed threshold S1, and it is correctly determined that the multi-feed of the medium has occurred.

In the graph 1020, the solid line 1021 shows the characteristics of the thickness information when the PPC paper M5 to which the adhered object P is adhered is conveyed. The adhered object P is a small medium such as a revenue stamp. When the adhered object P is adhered to the PPC paper M5, the PPC paper M5 and the adhered object P are in contact with each other closely. Therefore, the thickness of the PPC paper M5 and the adhered object P may be small, compared with the thickness of the PPC paper M5 and the adhered object P in the case where the adhered object P overlaps with the PPC paper M5 without being adhered to the PPC paper M5. Therefore, the thickness information in the portion V3 where the adhered object P is adhered to the PPC paper M5 is less than the thickness information in the portion V1 in which the PPC paper M1 and the PPC paper M2 overlap, and has a value between the first multi-feed threshold S1 and the second multi-feed threshold S2. Therefore, it is not determined that the multi-feed of the medium has occurred at the time T4 when the portion to which the adhered object P is adhered in the PPC paper M5 passes through the position of the thickness sensor 216. Further, since the length of the portion V3 to which the adhered object P is adhered in the PPC paper M5 is less than the size threshold L, the multi-feed threshold does not change from the second multi-feed threshold S2. Therefore, when the medium to which the small medium is adhered is conveyed, it is not determined that the multi-feed of the medium has occurred.

Similarly to the medium conveying apparatus 100, the medium conveying apparatus 200 may execute the multi-feed determination processing illustrated in FIG. 8, instead of the multi-feed determination processing illustrated in FIG. 6.

In that case, in step S301 of FIG. 8, the detection module 152 detects the thickness information indicated in the thickness signal, as the thickness information at a plurality of positions in the medium and stores it in the storage device 140 in association with the current time.

Further, in step S302, the detection module 152 determines whether or not the rear end of the medium has passed through the position of the thickness sensor 216. When the rear end of the medium passes through the position of the thickness sensor 216, in step S303, the calculation module 153 calculates the size of the area in which the thickness information detected by the detection module 152 is within a predetermined range in the conveyed medium as the overlap size.

Further, in step S305, the determination module 154 refers to the thickness information stored in the storage device 140, calculates a calculated value based on the thickness information for each thickness information detected by the detection module 152 in a fixed period, and determines whether or not each calculated value is equal to or less than the multi-feed threshold. When all the calculated values are equal to or less than the multi-feed threshold, in step S306, the determination module 154 determines that the multi-feed of the medium has not occurred. In particular, the determination module 154 determines that an adhered object is adhered to the conveyed medium to determine that the multi-feed of the medium has not occurred when the overlap size is less than the size threshold and the calculated value is equal to or less than the multi-feed threshold (the second multi-feed threshold), even when the calculated value is more than the first multi-feed threshold. On the other hand, when any of the calculated value is more than the multi-feed threshold, in step S307, the determination module 154 determines that the multi-feed of the medium has occurred.

Thus, the calculation module 153 calculates the overlap size after the detection of the thickness information by the detection module 152 is completed. The determination module 154 determines the multi-feed threshold based on the overlap size, and compares the value based on the thickness information detected by the detection module 152 at a plurality of positions with the determined multi-feed threshold.

As described in detail above, the medium conveying apparatus 200 determines whether or not the multi-feed of the medium has occurred based on the thickness information of the medium detected at a plurality of positions in the conveyed medium, and changes the determination threshold according to the size of the overlap area in the medium. Thus, the medium conveying apparatus 200 can determine whether or not the multi-feed of the medium has occurred with higher accuracy.

Figure 11:
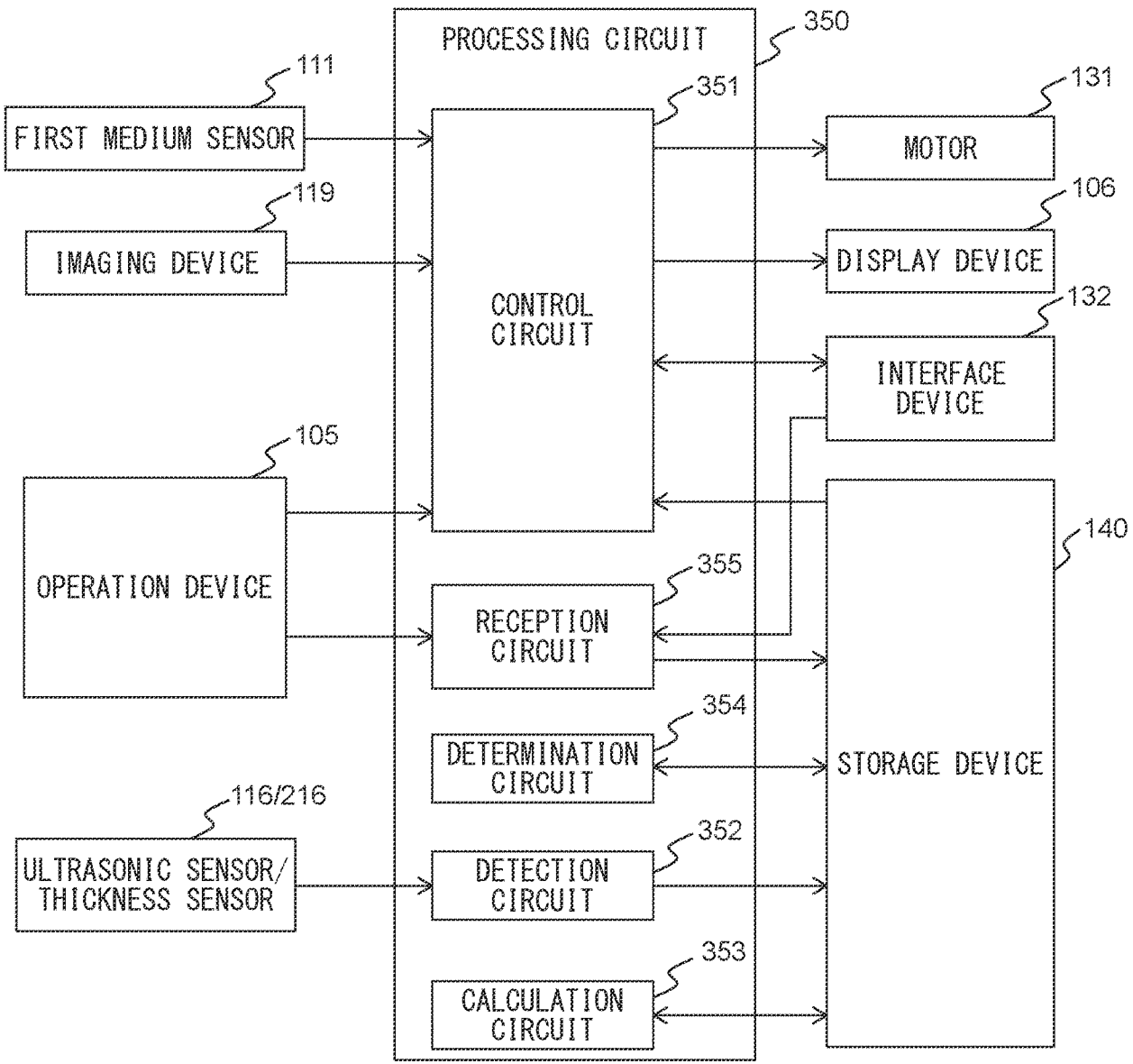
FIG. 11 is a diagram illustrating a schematic configuration of a processing circuit 350 in another medium conveying apparatus.

FIG. 11 is a diagram illustrating a schematic configuration of a processing circuit 350 of a medium conveying apparatus according to another embodiment.

The processing circuit 350 is used in place of the processing circuit 150 and executes the medium read processing, etc., instead of the processing circuit 150. The processing circuit 350 includes a control circuit 351, a detection circuit 352, a calculation circuit 353, a determination circuit 354 and a reception circuit 355, etc. Note that each unit may be configured by an independent integrated circuit, a microprocessor, firmware, etc.

The control circuit 351 is an example of a control module, and has a function similar to the control module 151. The control circuit 351 receives an operation signal from the operation device 105 or the interface device 132, receives the first medium signal from the first medium sensor 111, and controls the motor 131 to convey the medium based on each received signal. The control circuit 351 acquires the input image from the imaging device 119, and outputs it to the interface device 132. Further, the control circuit 351 reads the determination result of whether or not the multi-feed has occurred from the storage device 140, and executes the abnormality processing when it is determined that the multi-feed of the medium has occurred.

The detection circuit 352 is an example of a detection module, and has a functions similar to the detection module 152. The detection circuit 352 receives the ultrasonic signal from the ultrasonic sensor 116 or the thickness signal from the thickness sensor 216, detects the transmission information or the thickness information at a plurality of positions in the medium based on the received signal, and stores it in the storage device 140.

The calculation circuit 353 is an example of a calculation module, and has a function similar to the calculation module 153. The calculation circuit 353 reads the transmission information or the thickness information from the storage device 140, calculates the overlap size based on the read information, and stores it in the storage device 140.

The determination circuit 354 is an example of a determination module, and has a functions similar to the determination module 154. The determination circuit 354 reads the overlap size from the storage device 140, and sets the multi-feed threshold based on the overlap size. Further, the determination circuit 354 reads the transmission information or the thickness information from the storage device 140, determines whether or not the multi-feed of the medium has occurred by comparing it with the set multi-feed threshold, and stores the determination result in the storage device 140.

The reception circuit 355 is an example of a reception module, and has a functions similar to the reception module 155. The reception circuit 355 receives the result information from the operation device 105 or the interface device 132, reads the determination sensitivity of the multi-feed from the storage device 140, corrects the determination sensitivity of the multi-feed based on the received result information, and stores it in the storage device 140.

As described in detail above, the medium conveying apparatus can determine whether or not the multi-feed of the medium has occurred with higher accuracy even when the medium reading processing and the multi-feed determination processing are executed by the processing circuit 350.

According to the embodiment, the medium conveying apparatus, the method, and the computer-readable, non-transitory medium storing the control program, can determine whether or not the multi-feed of the medium has occurred with higher accuracy.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a conveying roller to convey a medium; and a processor to detect transmission information of an ultrasonic wave transmitted through the medium or thickness information of the medium at a plurality of positions in the conveyed medium, calculate a size of an area in which the transmission information or the thickness information is within a predetermined range in the conveyed medium, determine whether a multi-feed of the medium has occurred, by comparing a value based on the transmission information or the thickness information with a threshold, and execute an abnormality processing when it is determined that the multi-feed of the medium has occurred, wherein the processor changes the threshold according to the size.

2. The medium conveying apparatus according to claim 1, wherein the processor updates the size each time the processor detects the transmission information or the thickness information, compares the value based on the transmission information or the thickness information with the threshold each time the processor detects the transmission information or the thickness information, and changes the threshold when the updated size is equal to or more than a size threshold.

3. The medium conveying apparatus according to claim 1, wherein the processor calculates the size after detection of the transmission information or the thickness information by the processor is completed, determines the threshold based on the size, and compares the value based on the transmission information or the thickness information detected at the plurality of positions with the determined threshold.

4. The medium conveying apparatus according to claim 1, wherein the processor determines that an adhered object is adhered to the conveyed medium to determine that the multi-feed of the medium has not occurred when the size is less than a size threshold, and the value based on the transmission information is equal to or more than the threshold or the value based on the thickness information is equal to or less than the threshold.

5. The medium conveying apparatus according to claim 1, wherein the processor receives result information indicating whether a determination result of the multi-feed of the medium by the processor is correct, from a user, and corrects the threshold based on the result information.

6. The medium conveying apparatus according to claim 1, wherein the processor changes the threshold according to whether the size is equal to or more than a size threshold, receives result information indicating whether a determination result of the multi-feed of the medium by the processor is correct, from a user, and corrects the size threshold based on the result information.

7. A method for determining a multi-feed of a medium, comprising:

conveying the medium, by a conveying roller;

detecting transmission information of an ultrasonic wave transmitted through the medium or thickness information of the medium at a plurality of positions in the conveyed medium;

calculating a size of an area in which the transmission information or the thickness information is within a predetermined range in the conveyed medium;

determining whether a multi-feed of the medium has occurred, by comparing a value based on the transmission information or the thickness information with a threshold; and executing an abnormality processing when it is determined that the multi-feed of the medium has occurred, wherein the threshold is changed according to the size.

8. The method according to claim 7, wherein the size is updated each time the transmission information or the thickness information is detected, wherein the value based on the transmission information or the thickness information is compared with the threshold each time the transmission information or the thickness information is detected, and wherein the threshold is changed when the updated size is equal to or more than a size threshold.

9. The method according to claim 7, wherein the size is calculated after detection of the transmission information or the thickness information is completed, wherein the threshold is determined based on the size, and wherein the value based on the transmission information or the thickness information detected at the plurality of positions is compared with the determined threshold.

10. The method according to claim 7, wherein it is determined that an adhered object is adhered to the conveyed medium to determine that the multi-feed of the medium has not occurred when the size is less than a size threshold, and the value based on the transmission information is equal to or more than the threshold or the value based on the thickness information is equal to or less than the threshold.

11. The method according to claim 7, wherein result information indicating whether a determination result of the multi-feed of the medium is correct, is received from a user, and wherein the threshold is corrected based on the result information.

12. The method according to claim 7, wherein the threshold is changed according to whether the size is equal to or more than a size threshold, wherein result information indicating whether a determination result of the multi-feed of the medium is correct, is received from a user, and wherein the size threshold is corrected based on the result information.

13. A computer-readable, non-transitory medium storing a computer program, wherein the computer program causes a medium conveying apparatus including a conveying roller to convey a medium, to execute a process, the process comprising:

detecting transmission information of an ultrasonic wave transmitted through the medium or thickness information of the medium at a plurality of positions in the conveyed medium;

calculating a size of an area in which the transmission information or the thickness information is within a predetermined range in the conveyed medium;

determining whether a multi-feed of the medium has occurred, by comparing a value based on the transmission information or the thickness information with a threshold; and executing an abnormality processing when it is determined that the multi-feed of the medium has occurred, wherein the threshold is changed according to the size.

14. The computer-readable, non-transitory medium according to claim 13, wherein the size is updated each time the transmission information or the thickness information is detected, wherein the value based on the transmission information or the thickness information is compared with the threshold each time the transmission information or the thickness information is detected, and wherein the threshold is changed when the updated size is equal to or more than a size threshold.

15. The computer-readable, non-transitory medium according to claim 13, wherein the size is calculated after detection of the transmission information or the thickness information is completed, wherein the threshold is determined based on the size, and wherein the value based on the transmission information or the thickness information detected at the plurality of positions is compared with the determined threshold.

16. The computer-readable, non-transitory medium according to claim 13, wherein it is determined that an adhered object is adhered to the conveyed medium to determine that the multi-feed of the medium has not occurred when the size is less than a size threshold, and the value based on the transmission information is equal to or more than the threshold or the value based on the thickness information is equal to or less than the threshold.

17. The computer-readable, non-transitory medium according to claim 13, wherein result information indicating whether a determination result of the multi-feed of the medium is correct, is received from a user, and wherein the threshold is corrected based on the result information.

18. The computer-readable, non-transitory medium according to claim 13, wherein the threshold is changed according to whether the size is equal to or more than a size threshold, wherein result information indicating whether a determination result of the multi-feed of the medium is correct, is received from a user, and wherein the size threshold is corrected based on the result information.

* * * * *